US010230149B2

(12) United States Patent
Kim et al.

(10) Patent No.: US 10,230,149 B2
(45) Date of Patent: Mar. 12, 2019

(54) ELECTRICITY FEEDING STRUCTURE

(71) Applicant: LG INNOTEK CO., LTD., Seoul (KR)

(72) Inventors: Chang Wook Kim, Seoul (KR); Do Gyun Kim, Seoul (KR); Byung Youl Moon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 149 days.

(21) Appl. No.: 14/780,863

(22) PCT Filed: Mar. 26, 2014

(86) PCT No.: PCT/KR2014/002574
§ 371 (c)(1),
(2) Date: Sep. 28, 2015

(87) PCT Pub. No.: WO2014/157951
PCT Pub. Date: Oct. 2, 2014

(65) Prior Publication Data

US 2016/0056522 A1 Feb. 25, 2016

(30) Foreign Application Priority Data

Mar. 26, 2013 (KR) ..... 10-2013-0032091

(51) Int. Cl.
*H01P 7/08* (2006.01)
*H01Q 1/24* (2006.01)
(Continued)

(52) U.S. Cl.
CPC ..... *H01P 7/088* (2013.01); *H01Q 1/243* (2013.01); *H01Q 9/145* (2013.01); *H01Q 9/42* (2013.01)

(58) Field of Classification Search
CPC ..... H01P 7/088; H01Q 1/243; H01Q 9/145; H01Q 9/42
(Continued)

(56) References Cited

U.S. PATENT DOCUMENTS

2006/0139218 A1 6/2006 Jang
2010/0149049 A1 6/2010 Ryou et al.
(Continued)

FOREIGN PATENT DOCUMENTS

EP 2479838 A1 7/2012
EP 2498337 A1 9/2012
(Continued)

OTHER PUBLICATIONS

International Search Report in International Application No. PCT/KR2014/002574 filed Mar. 26, 2014.

*Primary Examiner* — Stephen E. Jones
*Assistant Examiner* — Samuel S Outten
(74) *Attorney, Agent, or Firm* — Saliwanchik, Lloyd & Eisenschenk

(57) ABSTRACT

The present invention relates to an electricity feeding structure, comprising: a resonator including an electricity feeding part and a ground part connected to the electricity feeding part; a resonance adding part disposed between the electricity feeding part and the ground part; and a controlling part disposed in at least one of the electricity feeding part, the resonance adding part and the ground part. According to the present invention, since the electricity feeding structure includes the controlling part, it is possible to easily control the resonant frequency band of an antenna device.

5 Claims, 23 Drawing Sheets

(51) Int. Cl.
*H01Q 9/14* (2006.01)
*H01Q 9/42* (2006.01)

(58) Field of Classification Search
USPC ..... 333/175
See application file for complete search history.

(56) References Cited

U.S. PATENT DOCUMENTS

| | | | | |
|---|---|---|---|---|
| 2011/0275333 | A1 | 11/2011 | Kim et al. | |
| 2012/0009983 | A1* | 1/2012 | Mow | H01Q 1/243 455/575.7 |
| 2012/0188134 | A1 | 7/2012 | Hotta et al. | |
| 2012/0231750 | A1 | 9/2012 | Jin et al. | |
| 2012/0242284 | A1* | 9/2012 | Wheatley, III | H02J 17/00 320/108 |
| 2013/0027260 | A1 | 1/2013 | Jeon et al. | |
| 2013/0321012 | A1* | 12/2013 | Nath | G01R 31/2808 324/750.02 |

FOREIGN PATENT DOCUMENTS

| | | | |
|---|---|---|---|
| JP | 2008-061009 | A | 3/2008 |
| KR | 10-2006-0073767 | A | 6/2006 |
| KR | 10-2008-0090063 | A | 10/2008 |
| KR | 10-2011-0019666 | A | 2/2011 |
| KR | 10-2011-0112227 | A | 10/2011 |
| KR | 10-2011-0123995 | A | 11/2011 |
| KR | 10-2012-0046962 | A | 5/2012 |
| KR | 10-2012-0088564 | A | 8/2012 |

* cited by examiner

[Fig. 1]
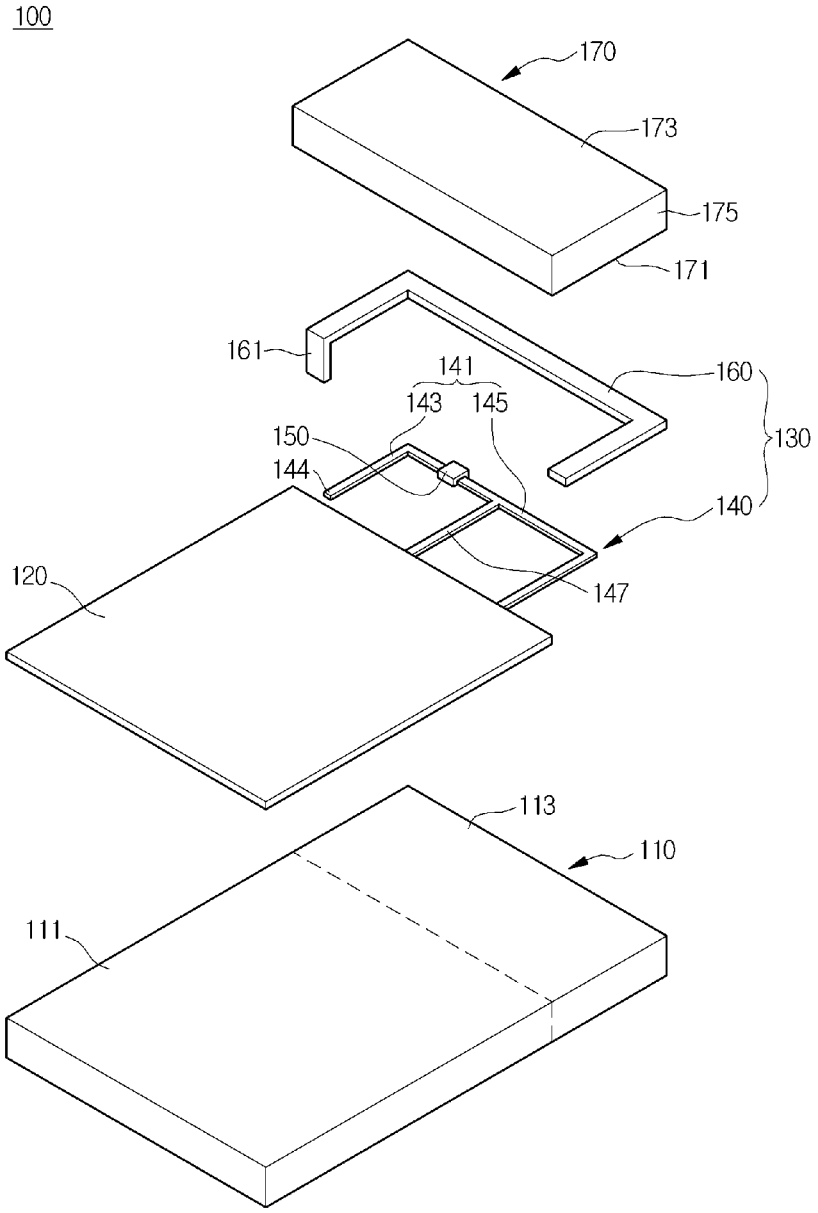

[Fig. 2]
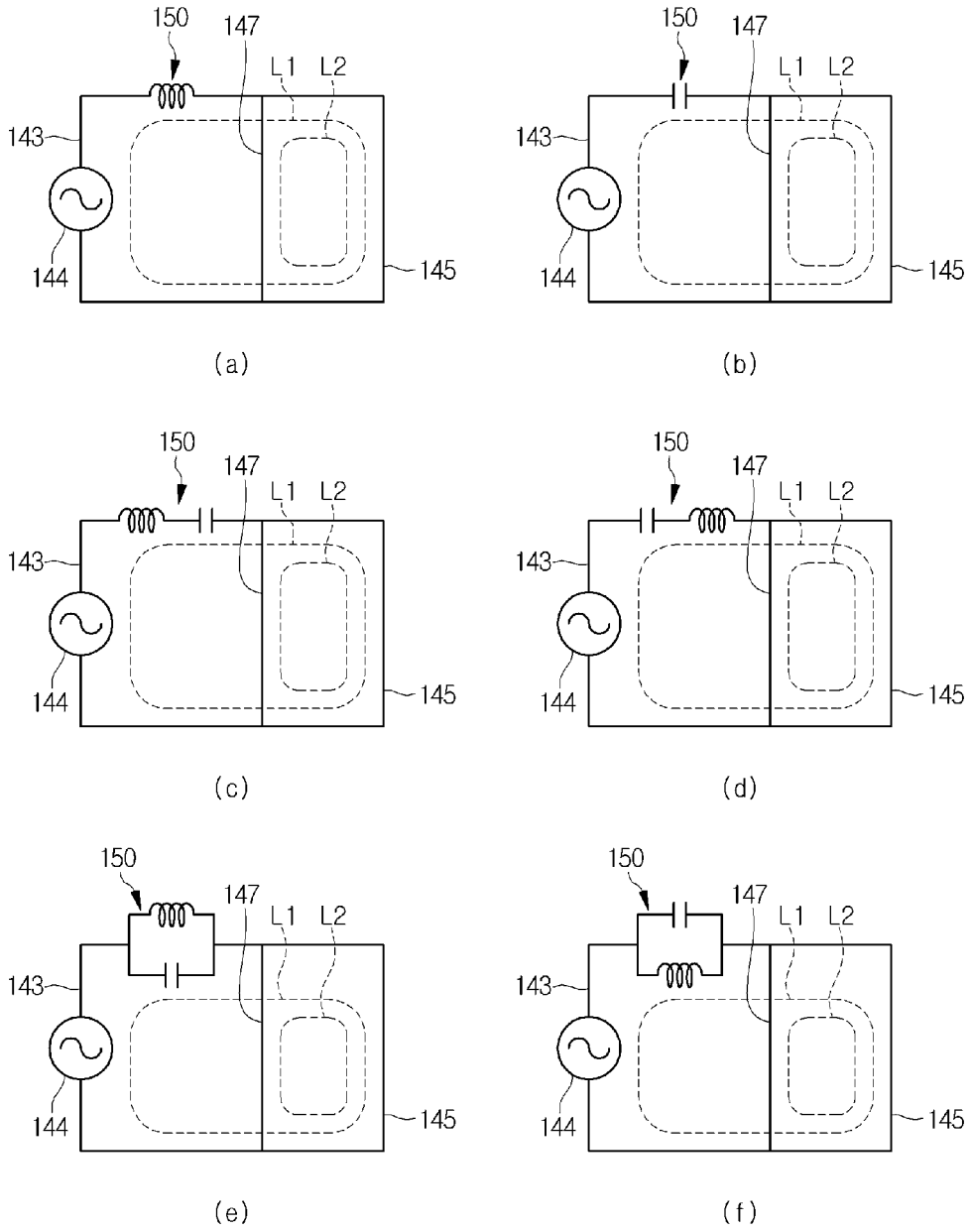

[Fig. 3]
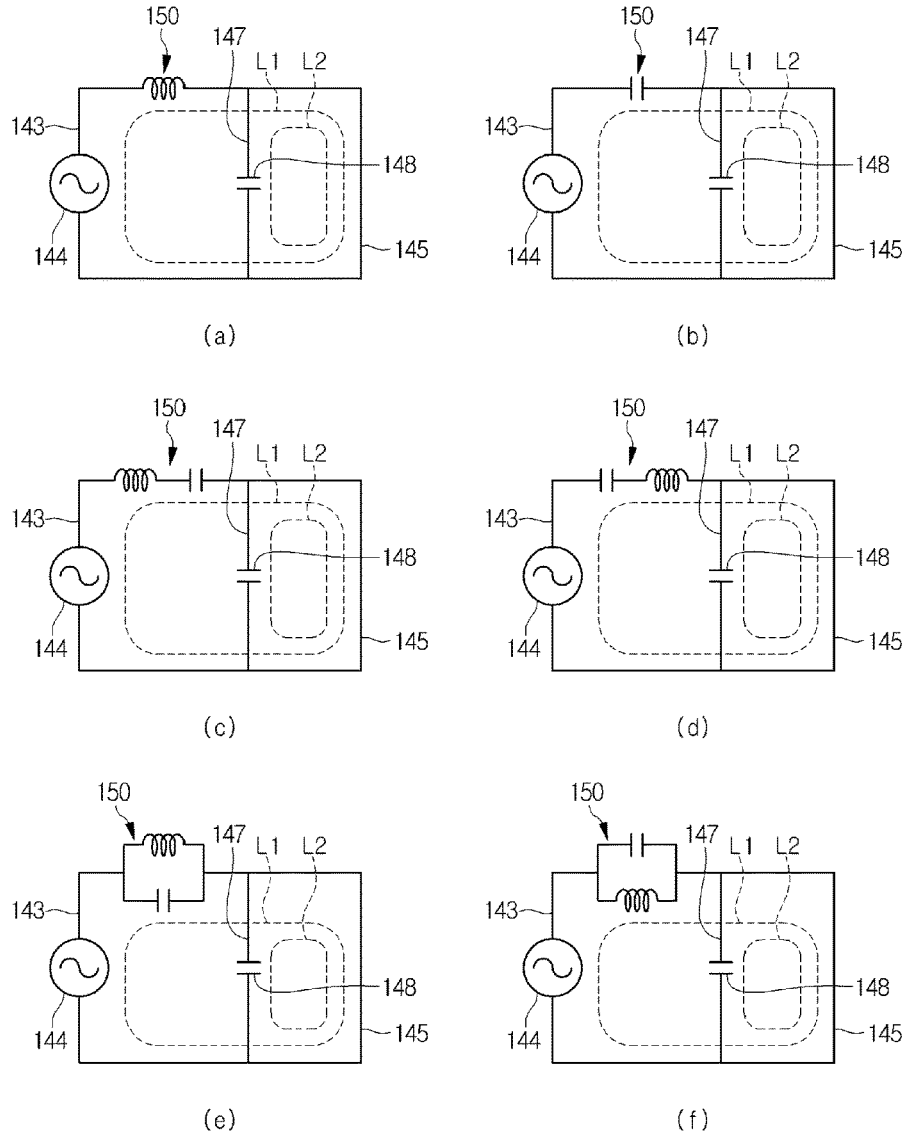
[Fig. 4]
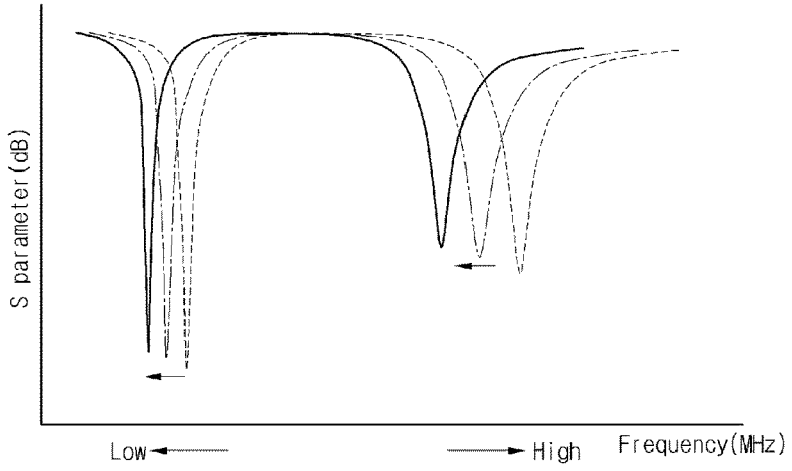

[Fig. 5]
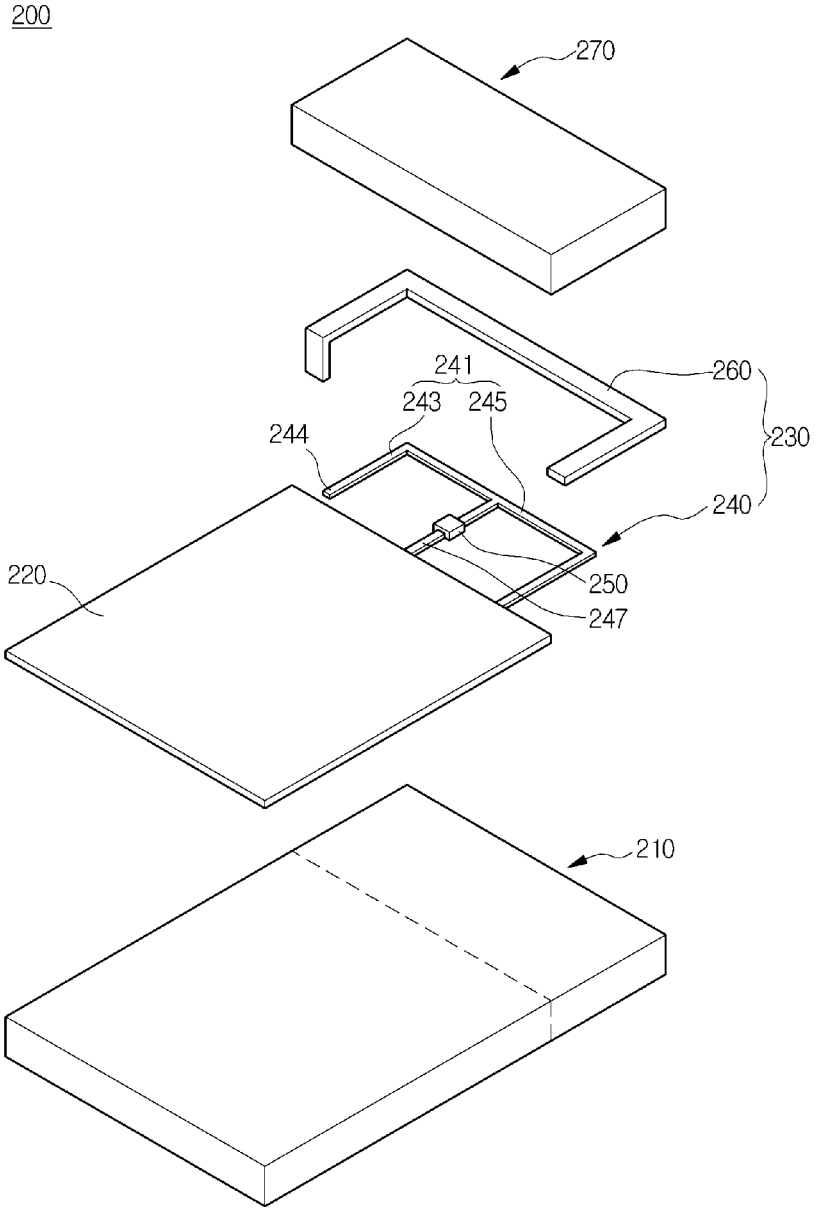

[Fig. 6]
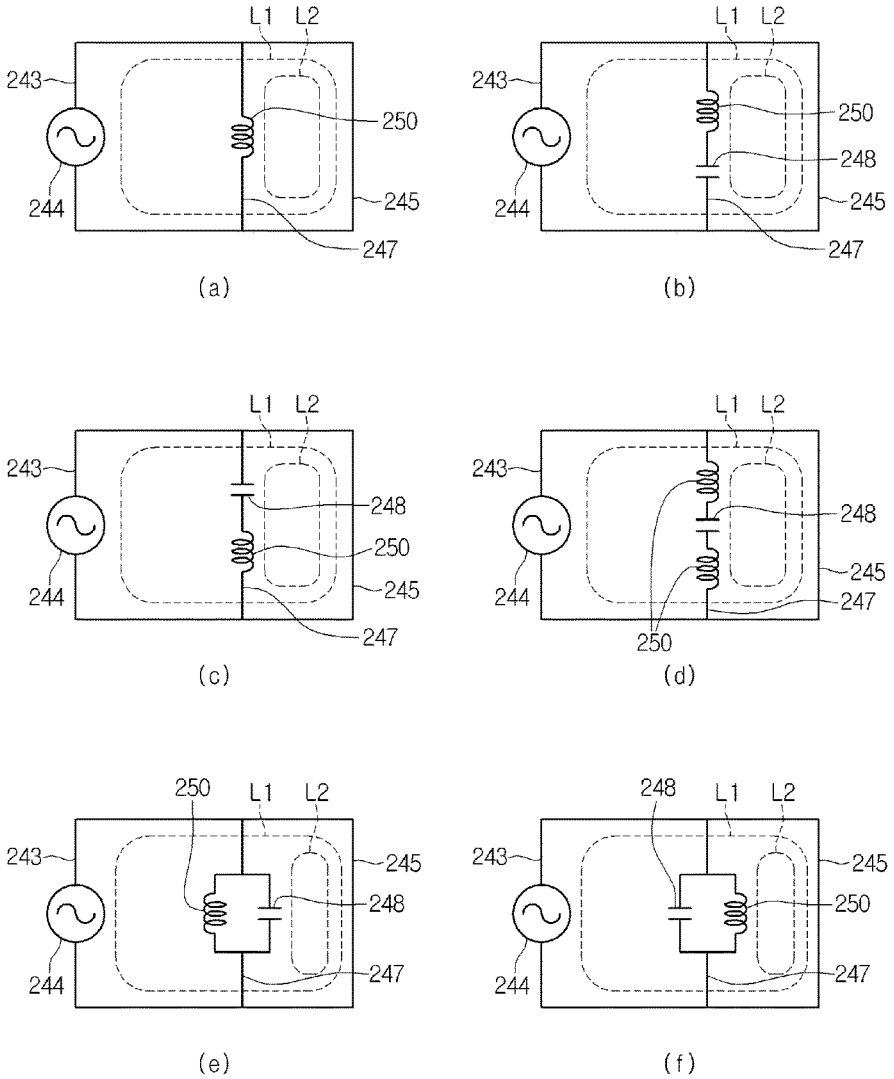
[Fig. 7]
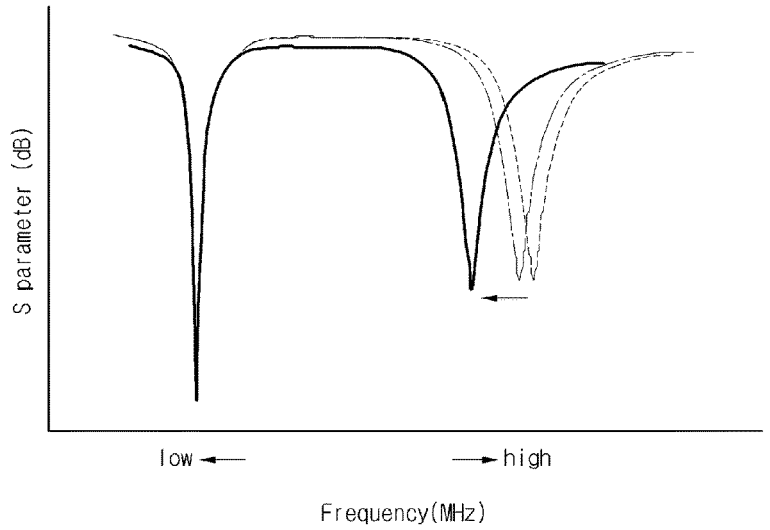

[Fig. 8]
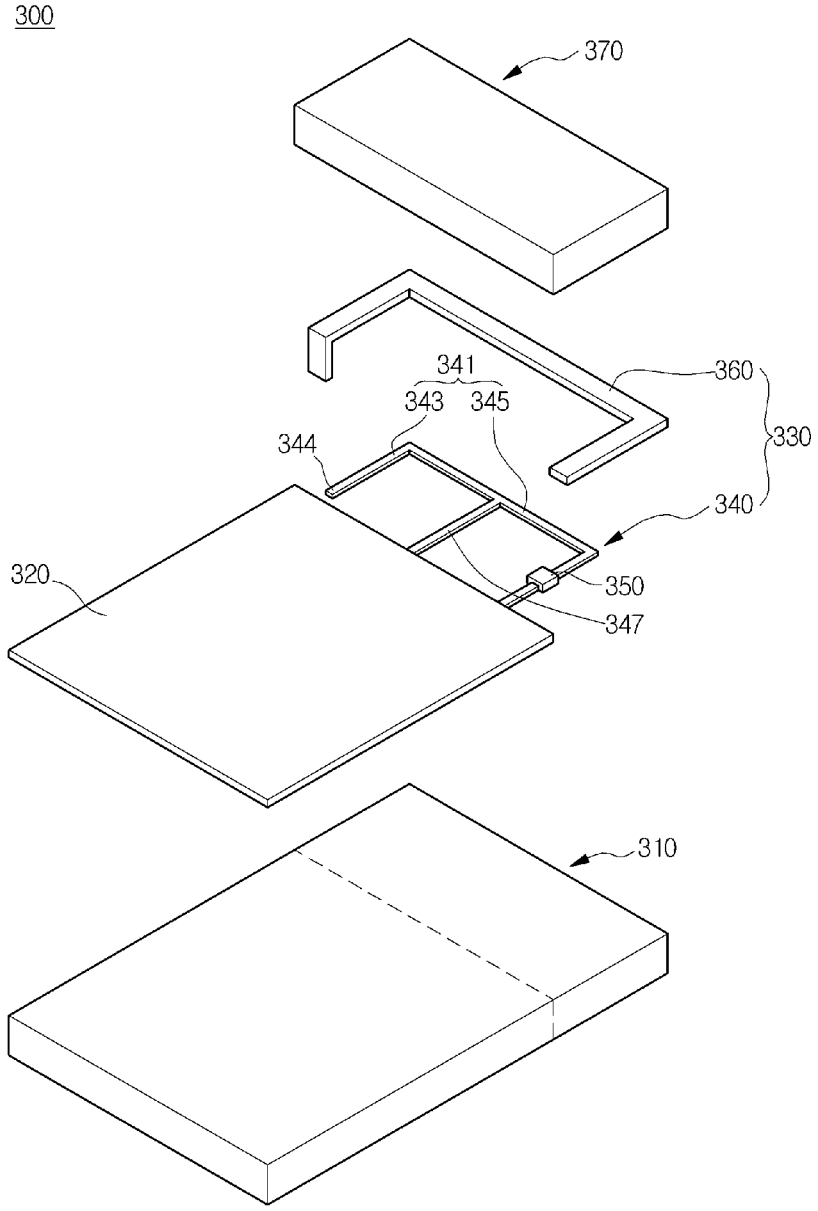

[Fig. 9]
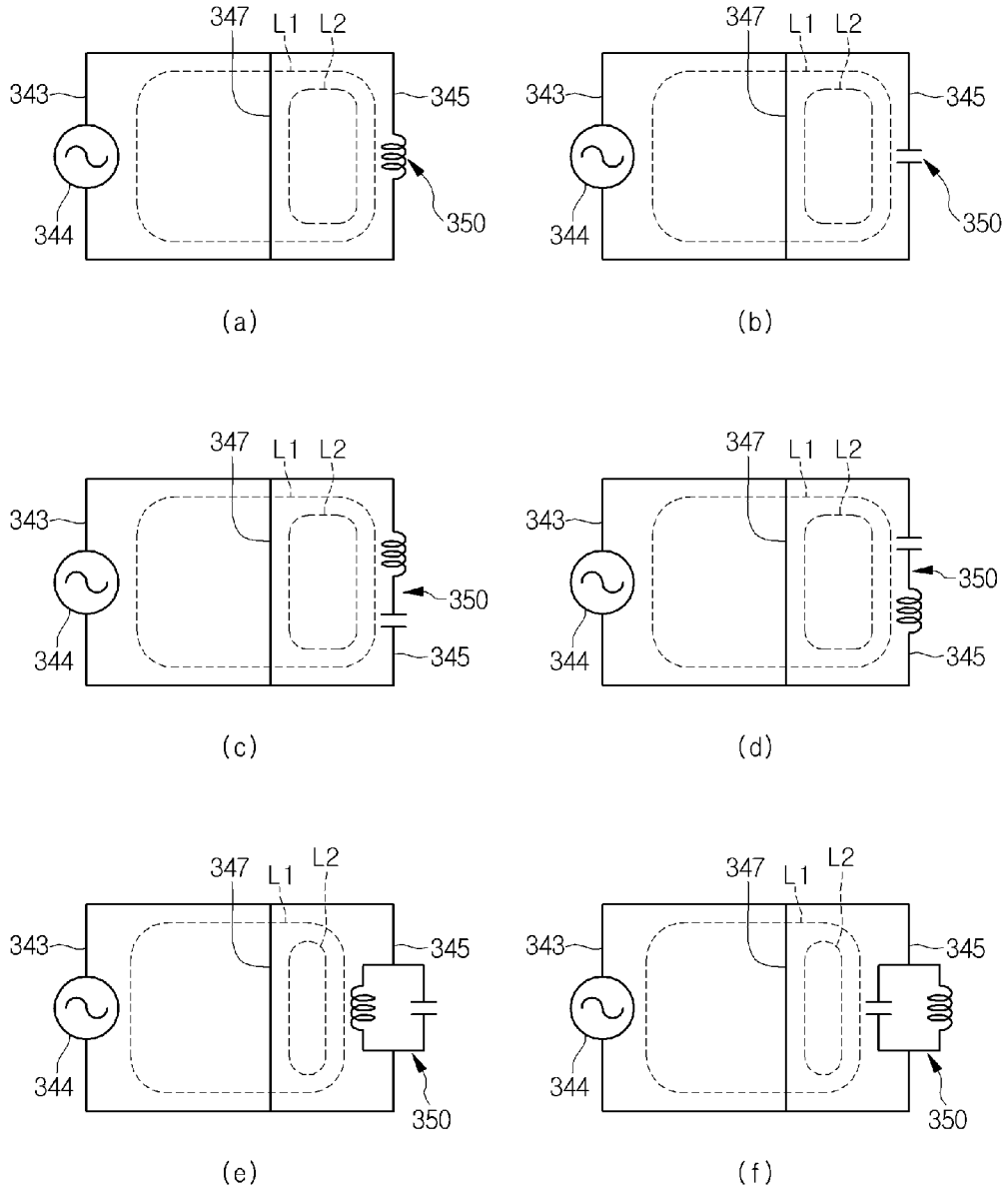

[Fig. 10]
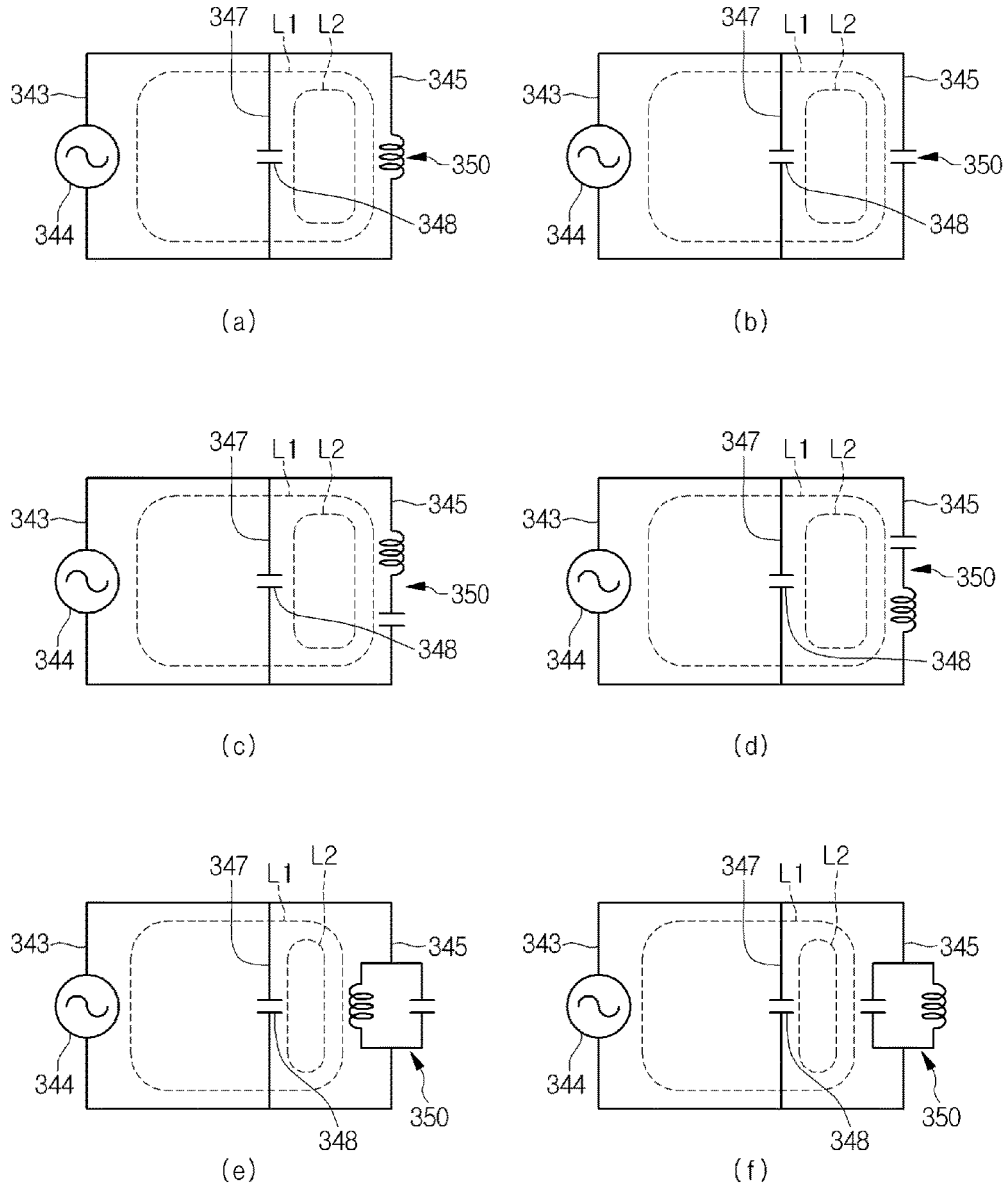

[Fig. 11]
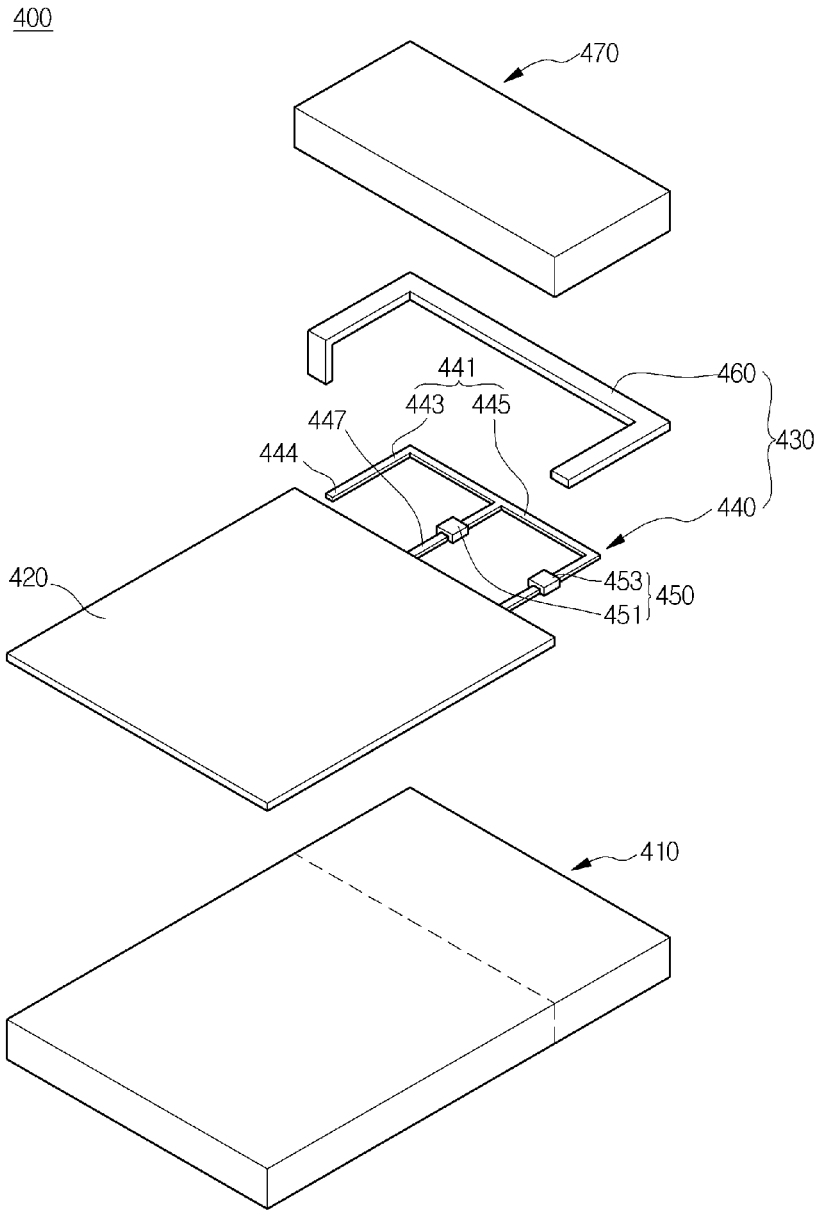

[Fig. 12]
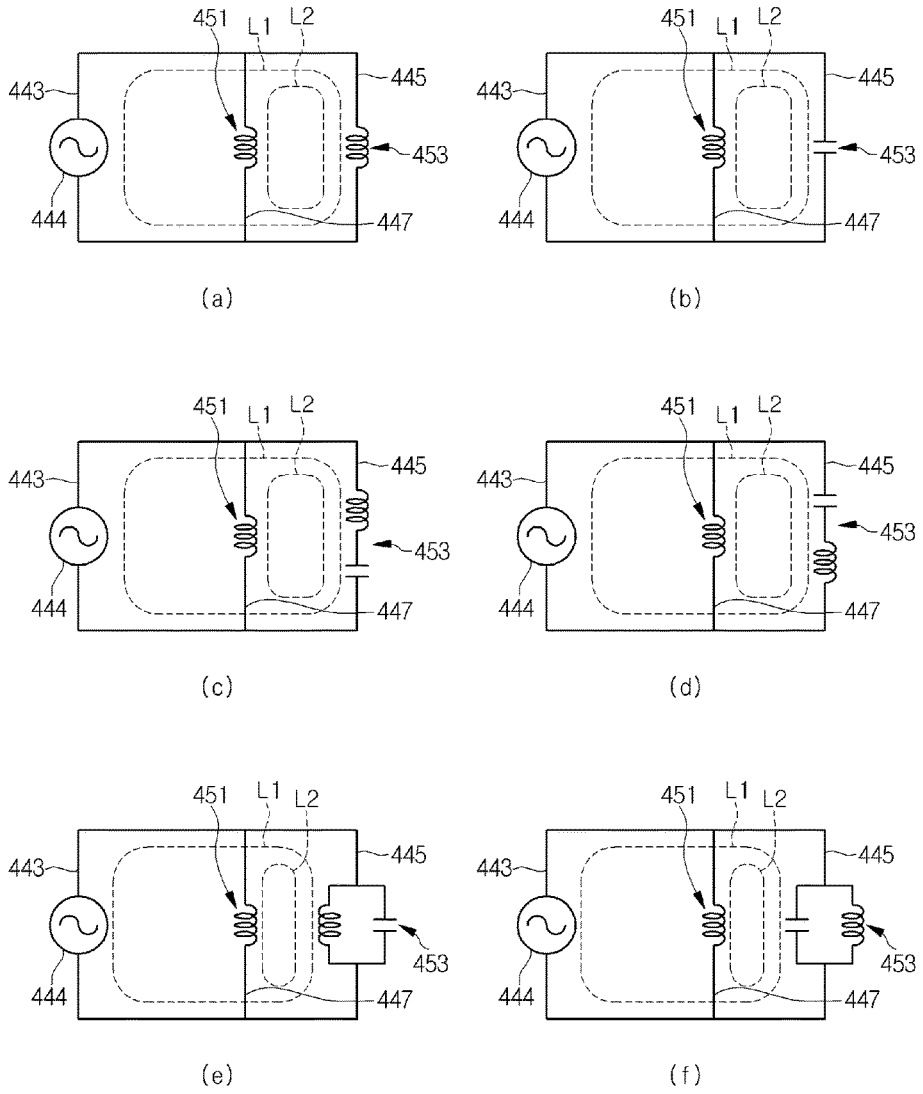

[Fig. 13]
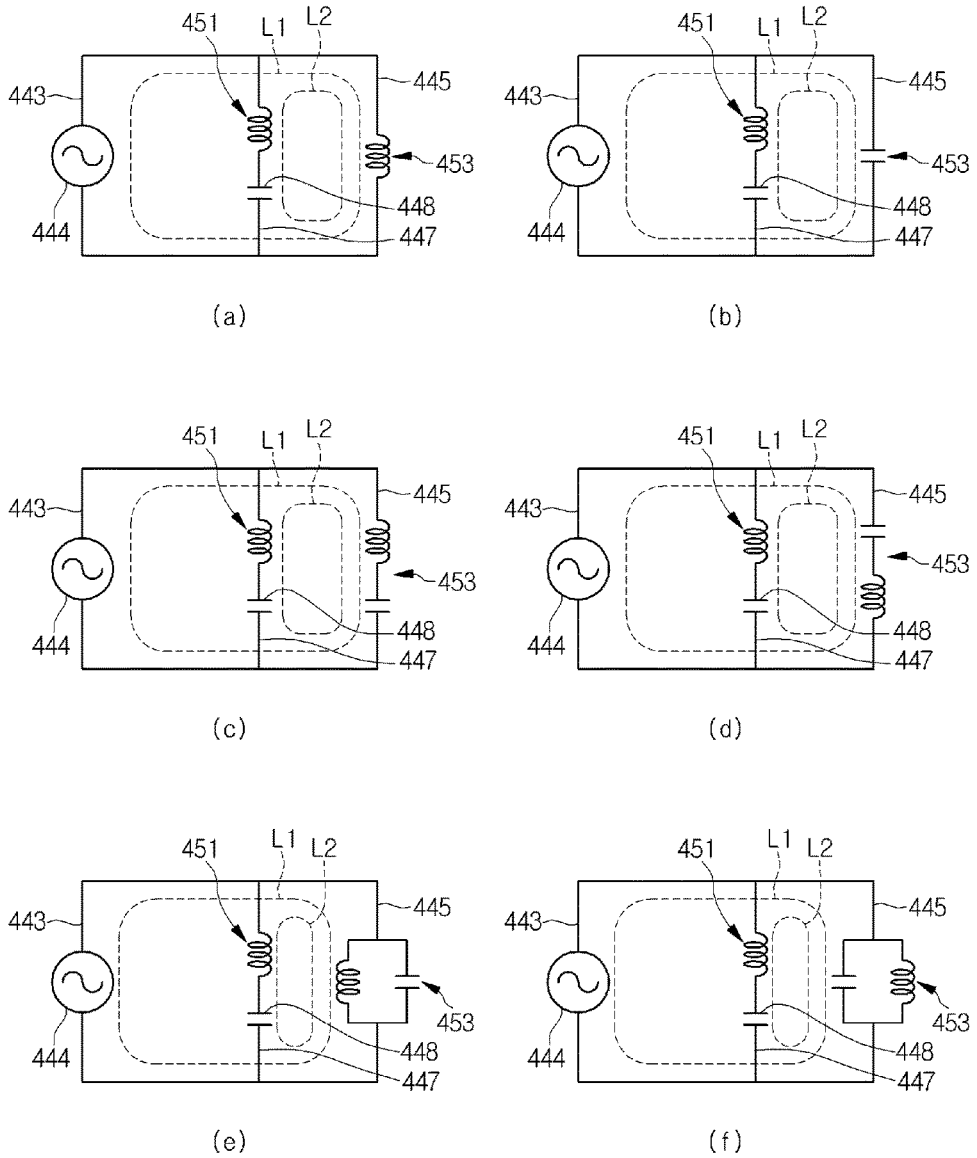

[Fig. 14]
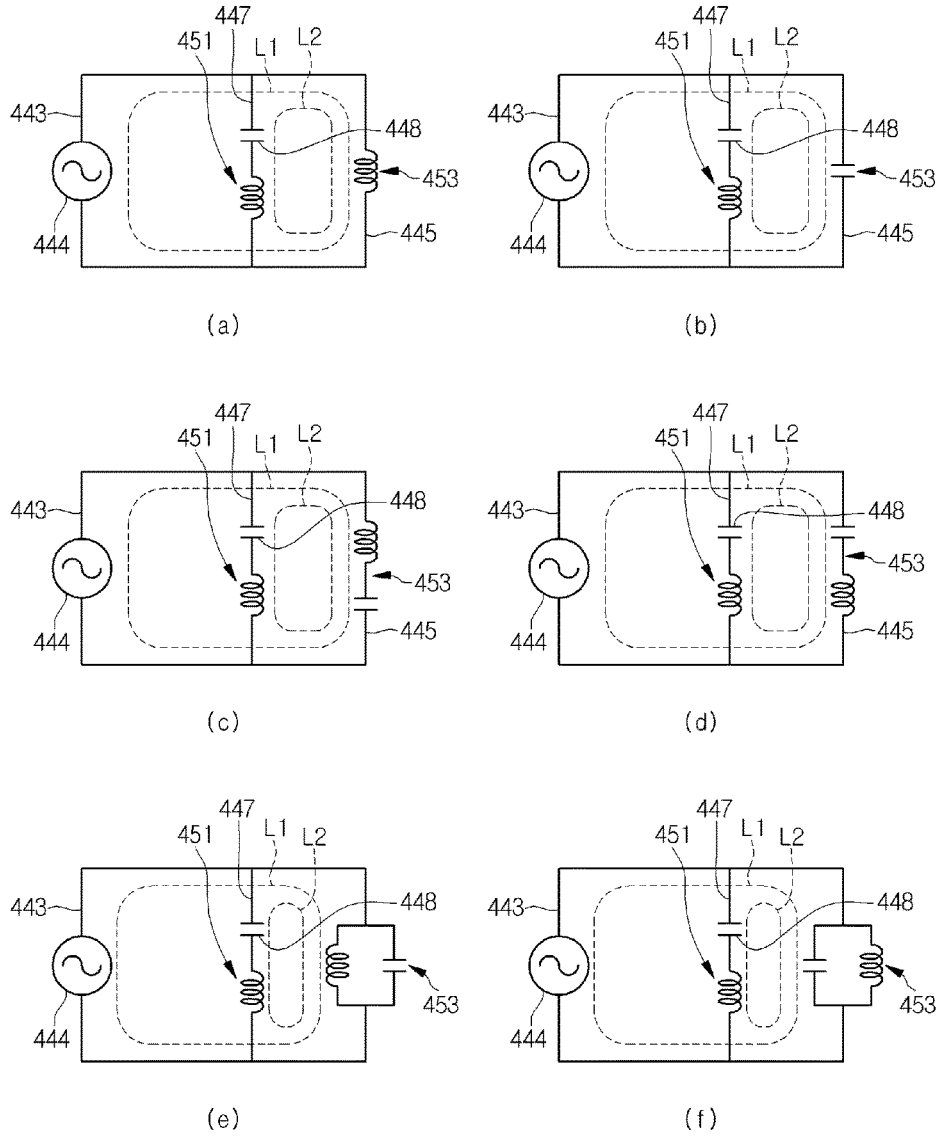

[Fig. 15]
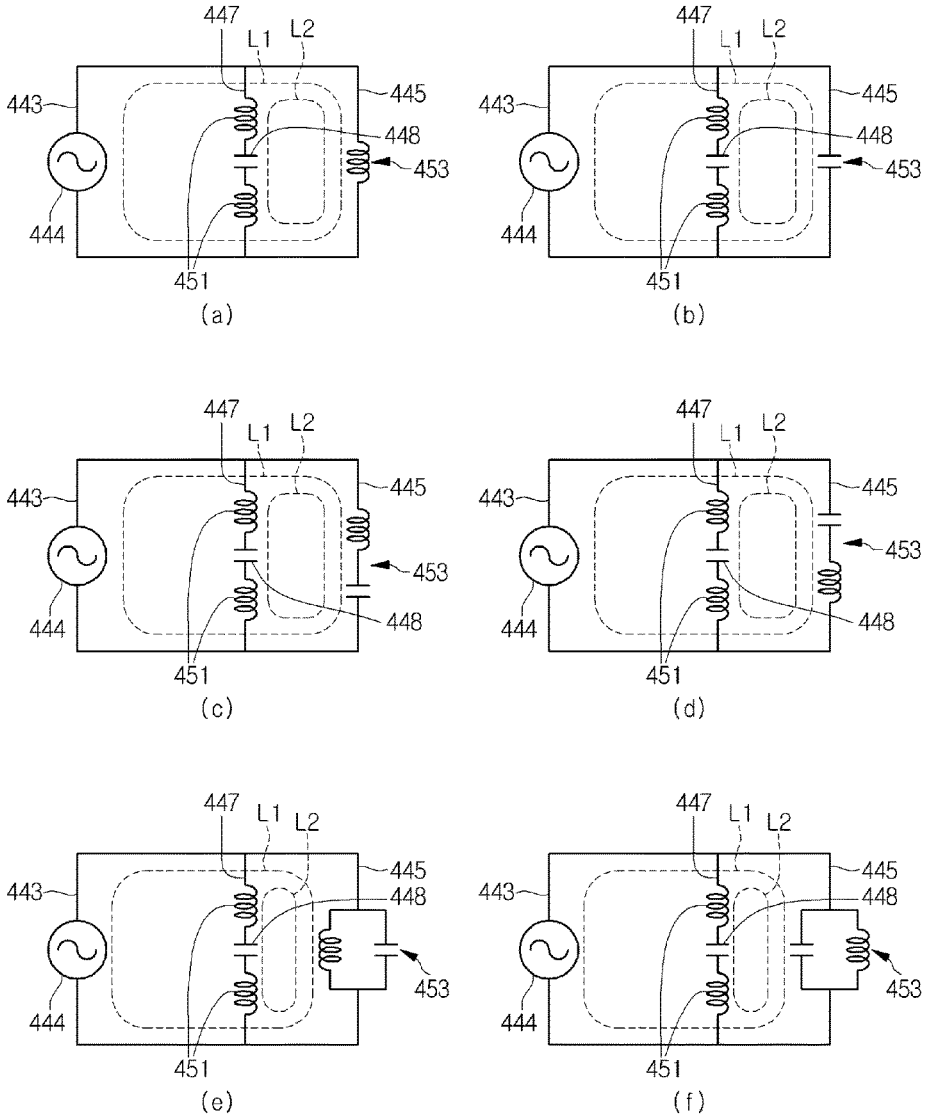

[Fig. 16]
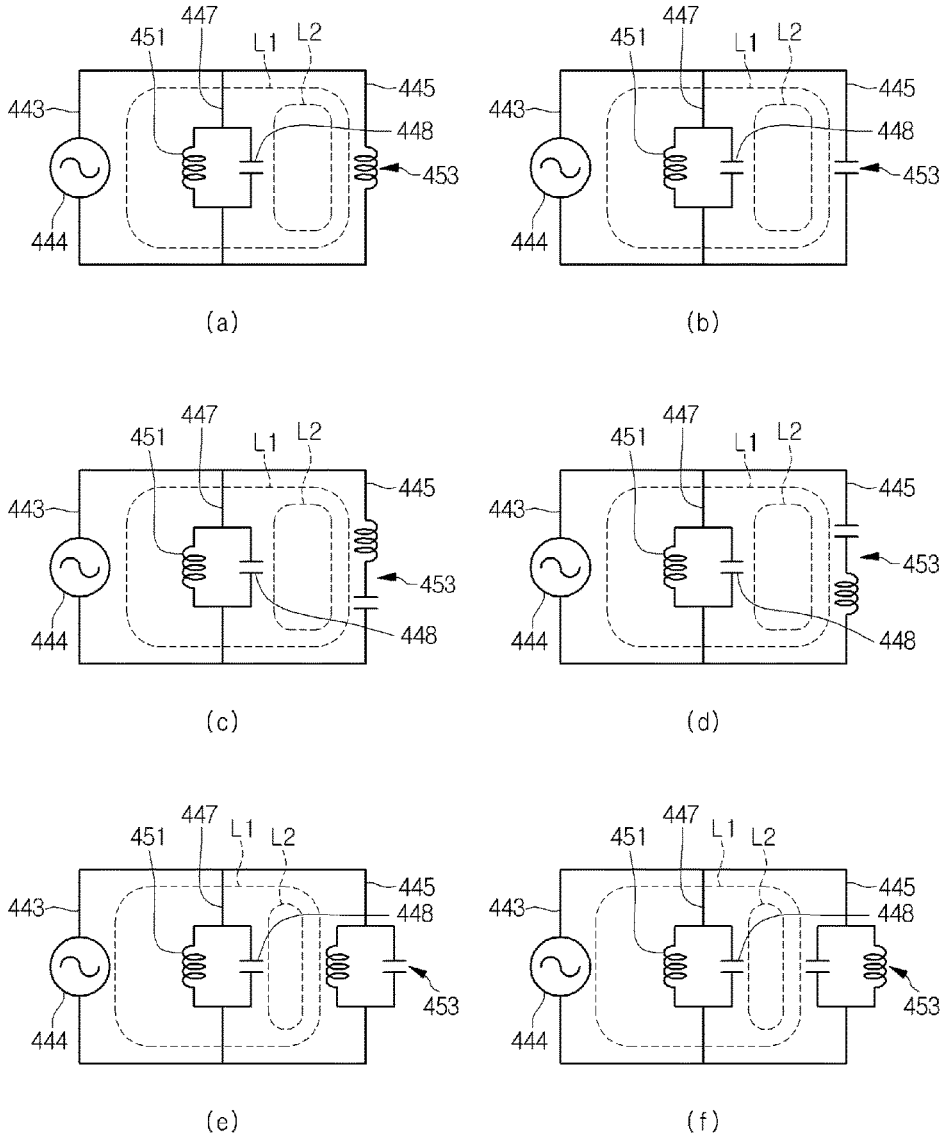

[Fig. 17]
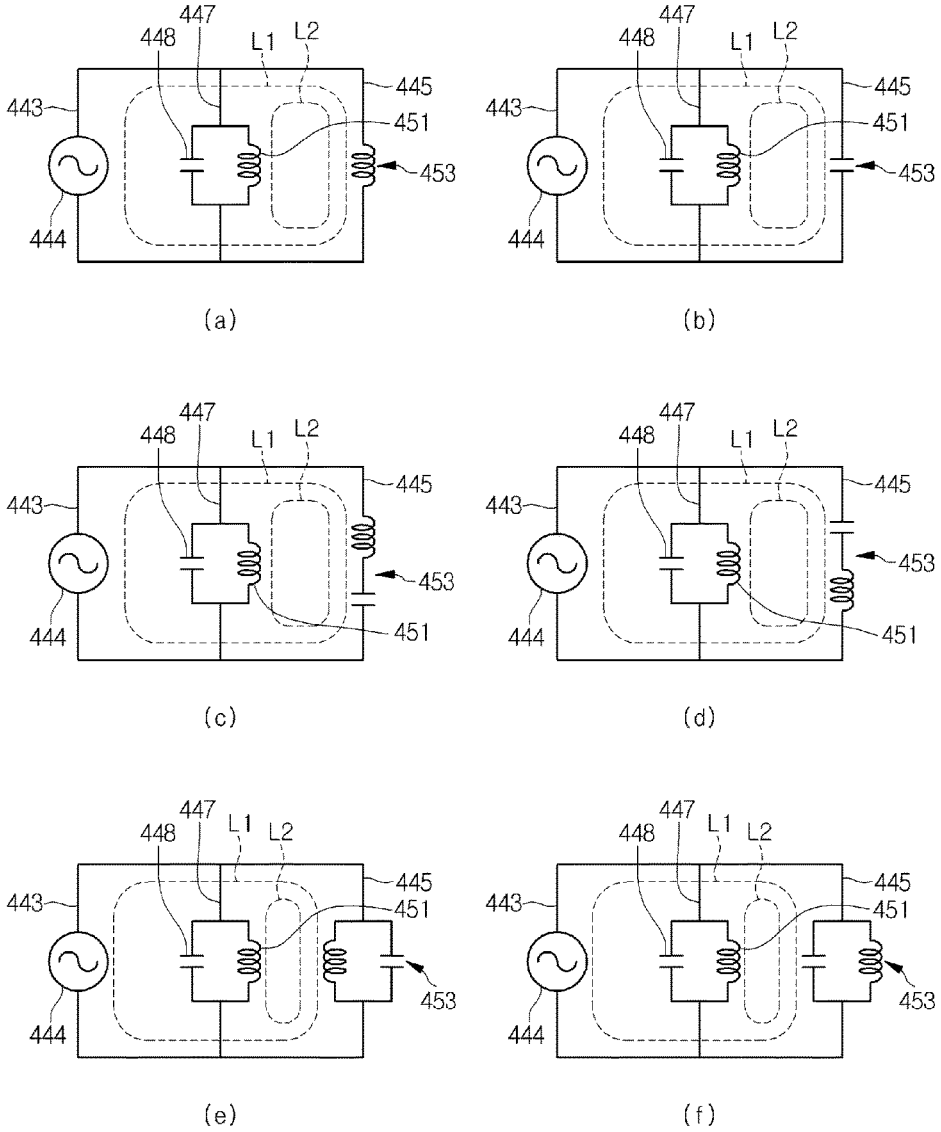

[Fig. 18]
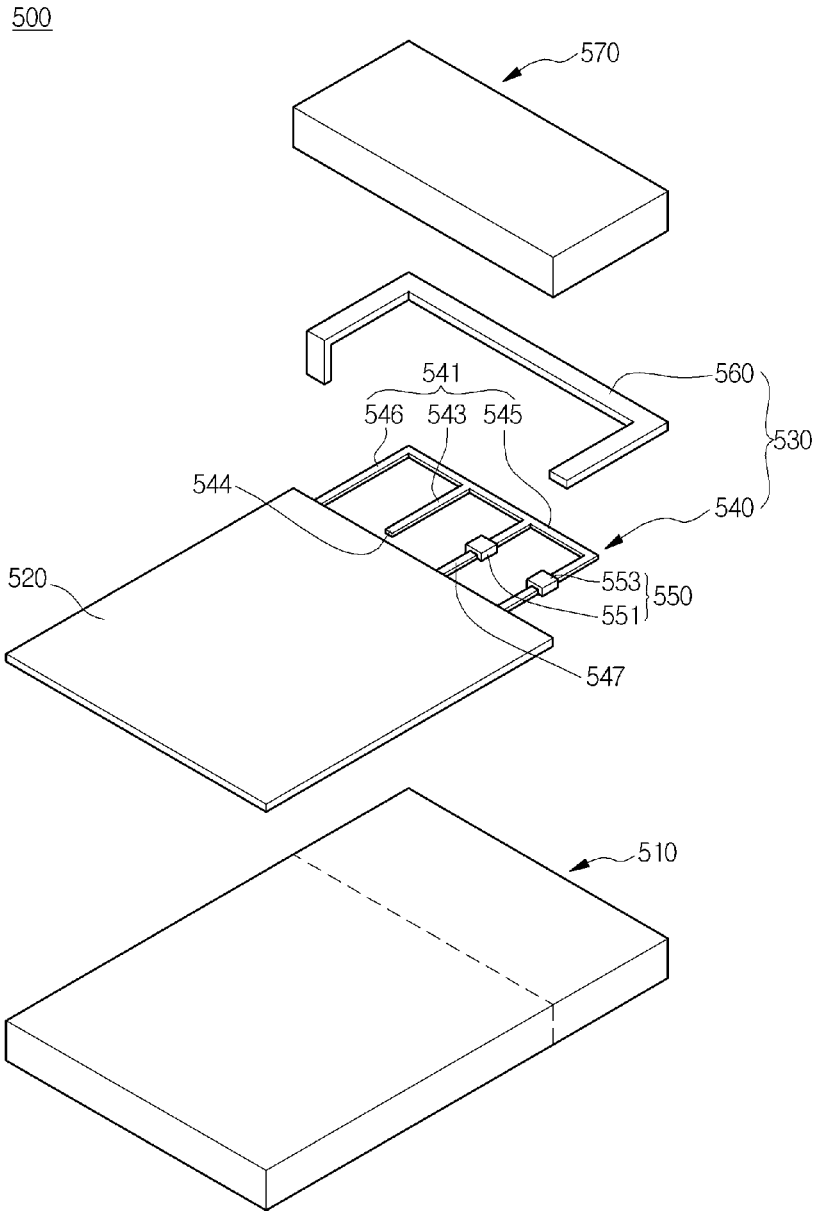

[Fig. 19]
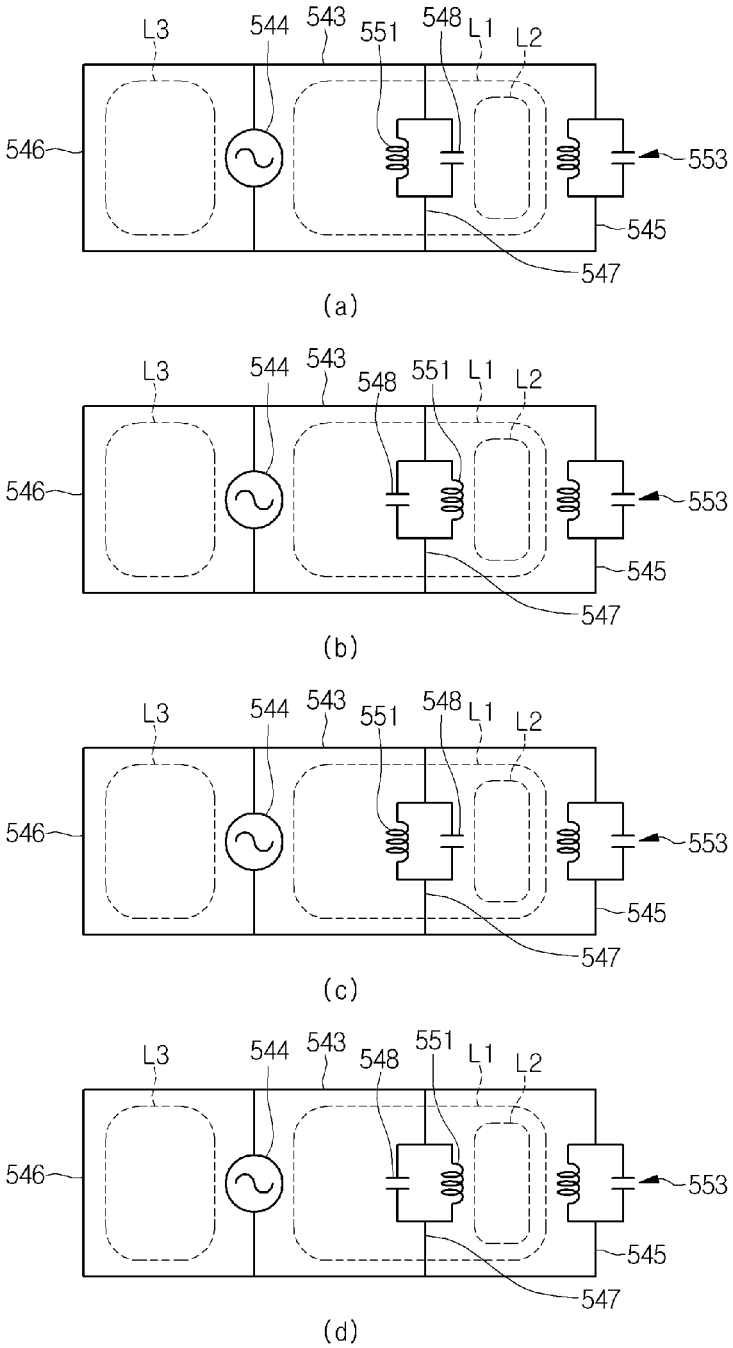

[Fig. 20]
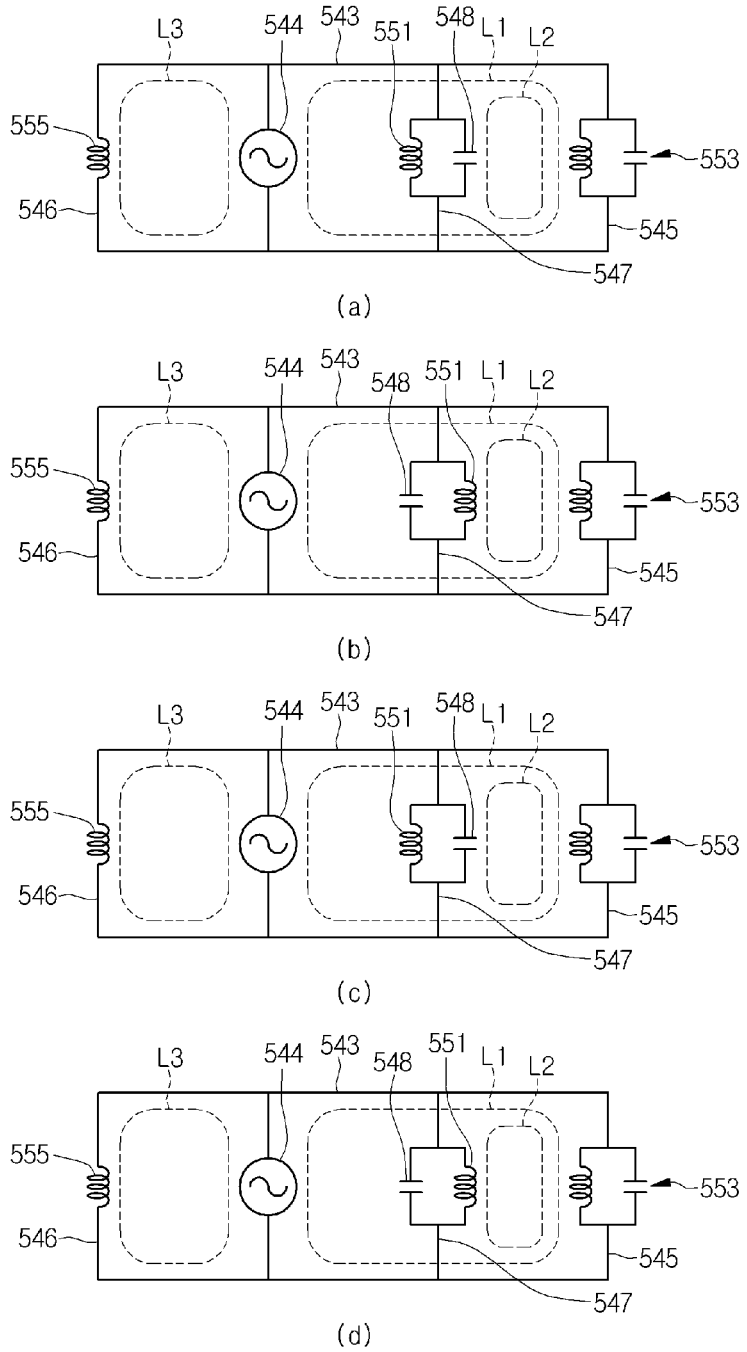

[Fig. 21]
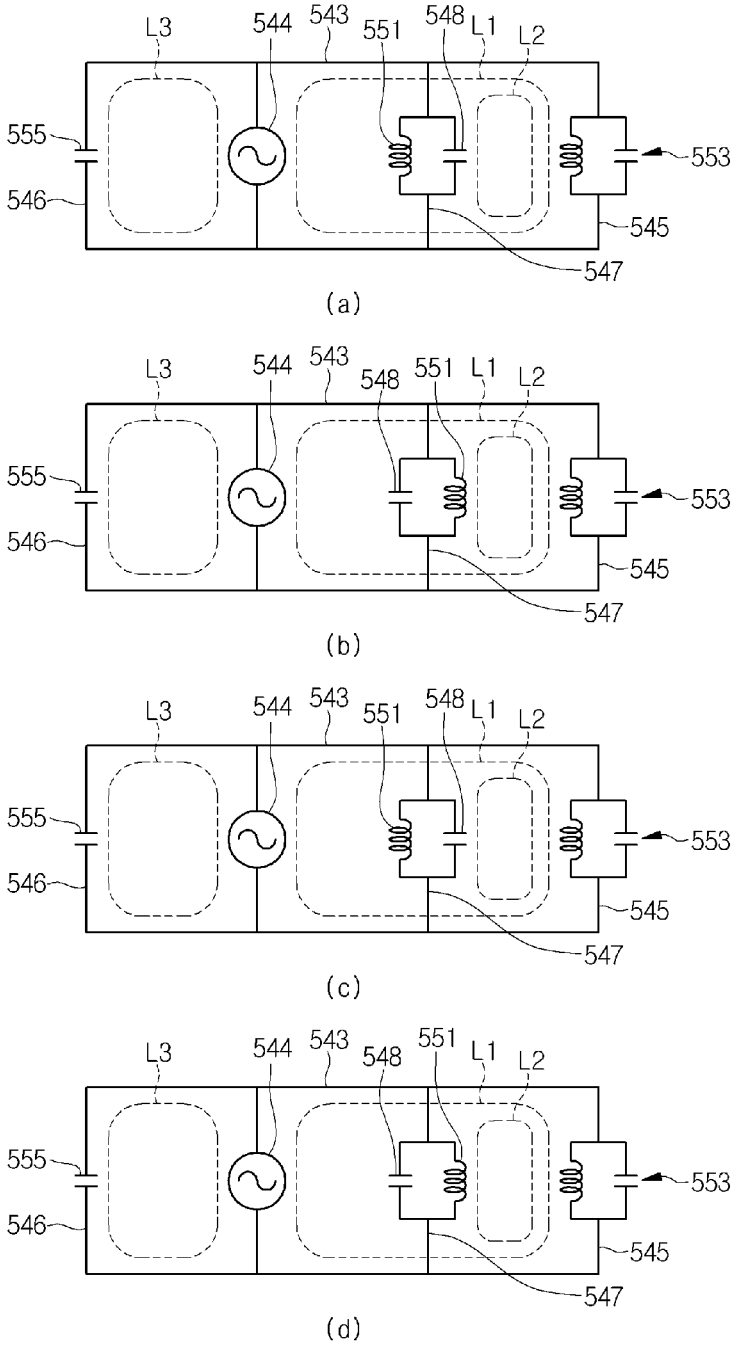

[Fig. 22]
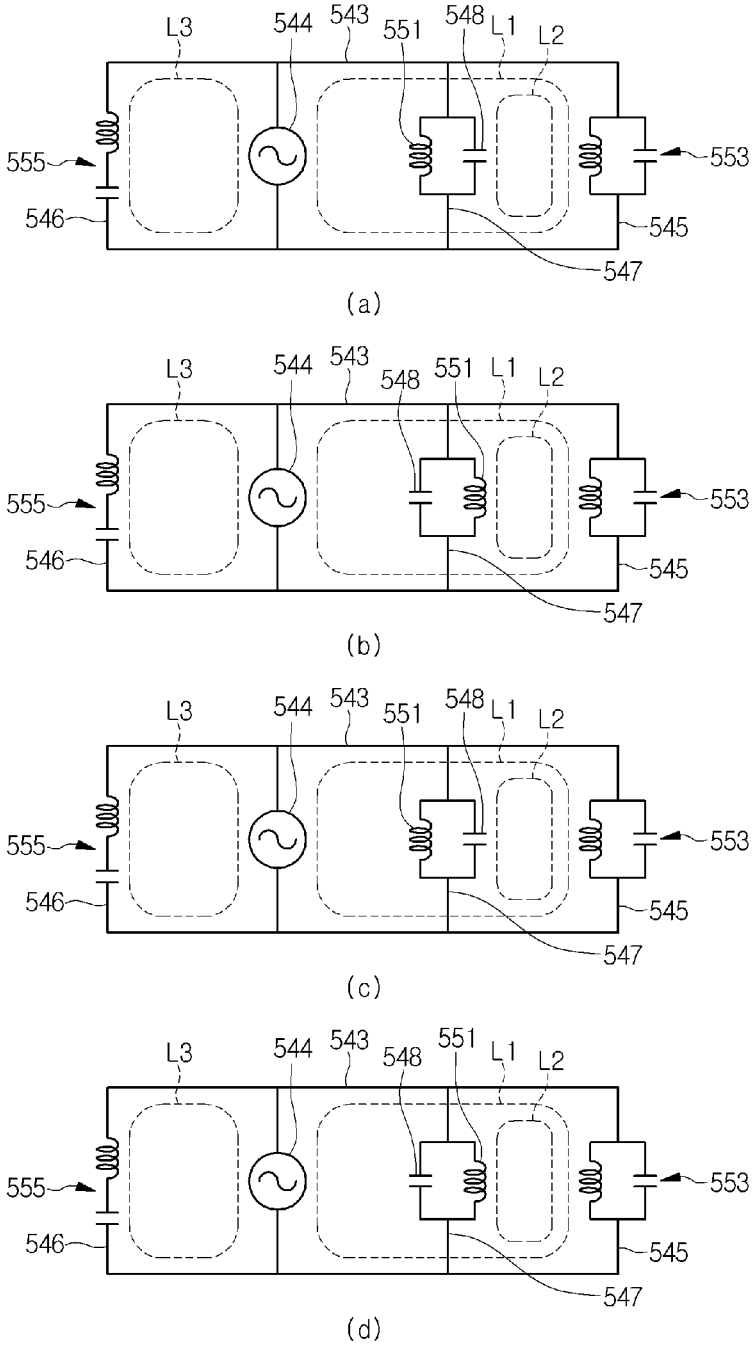

[Fig. 23]
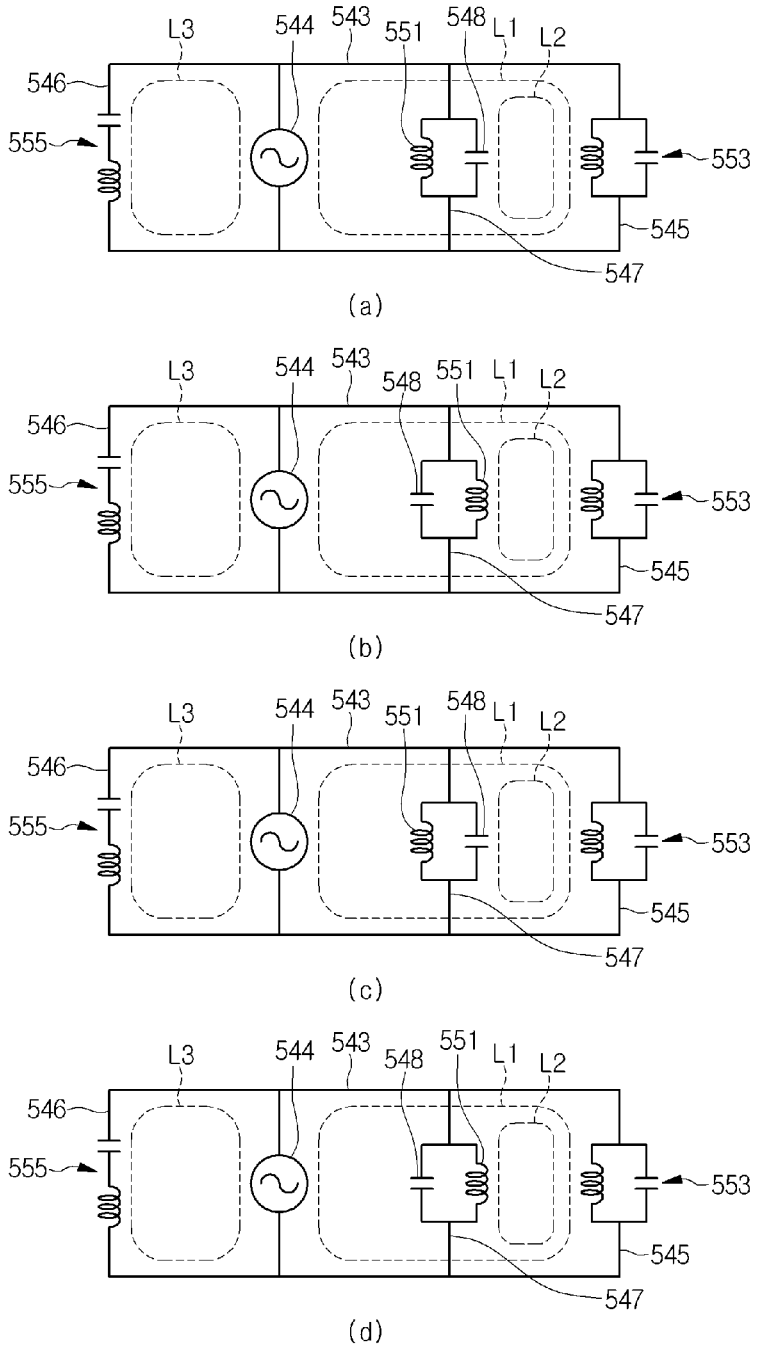

[Fig. 24]
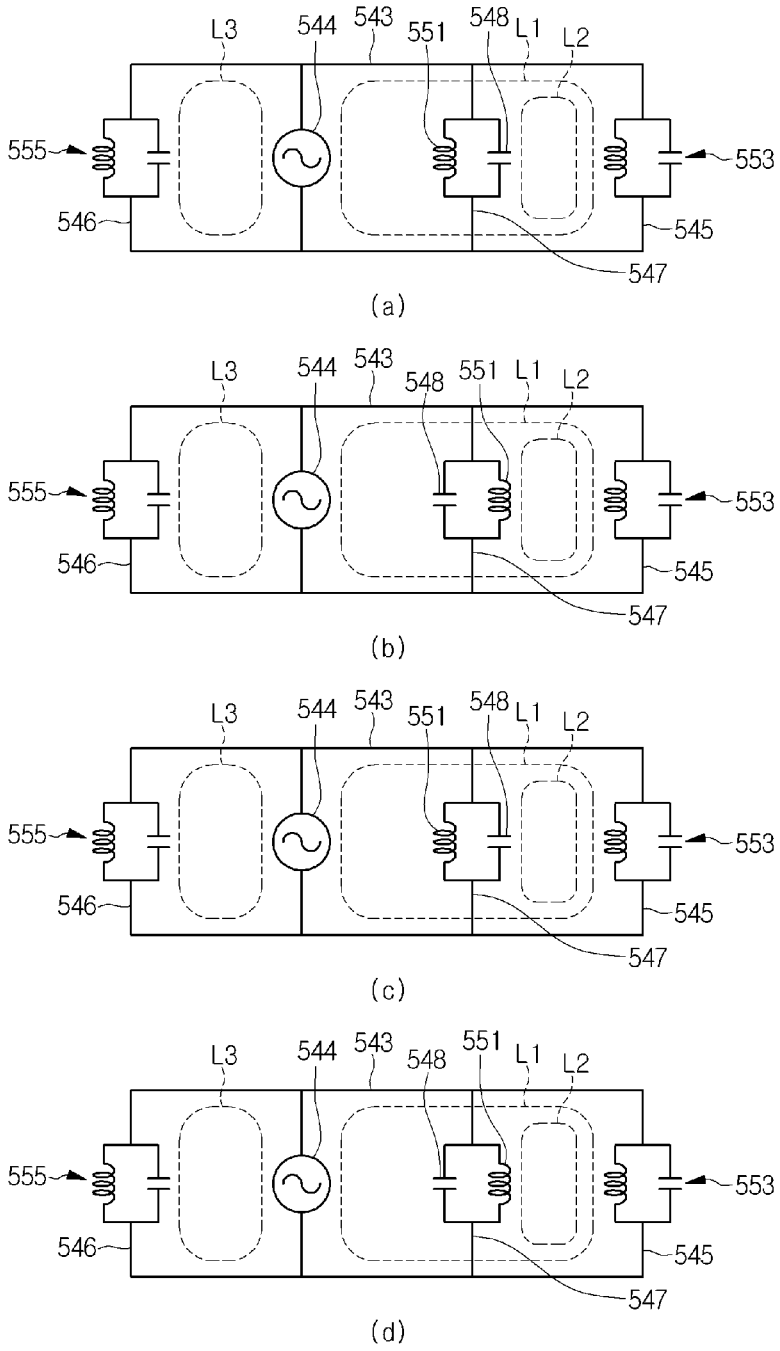

[Fig. 25]
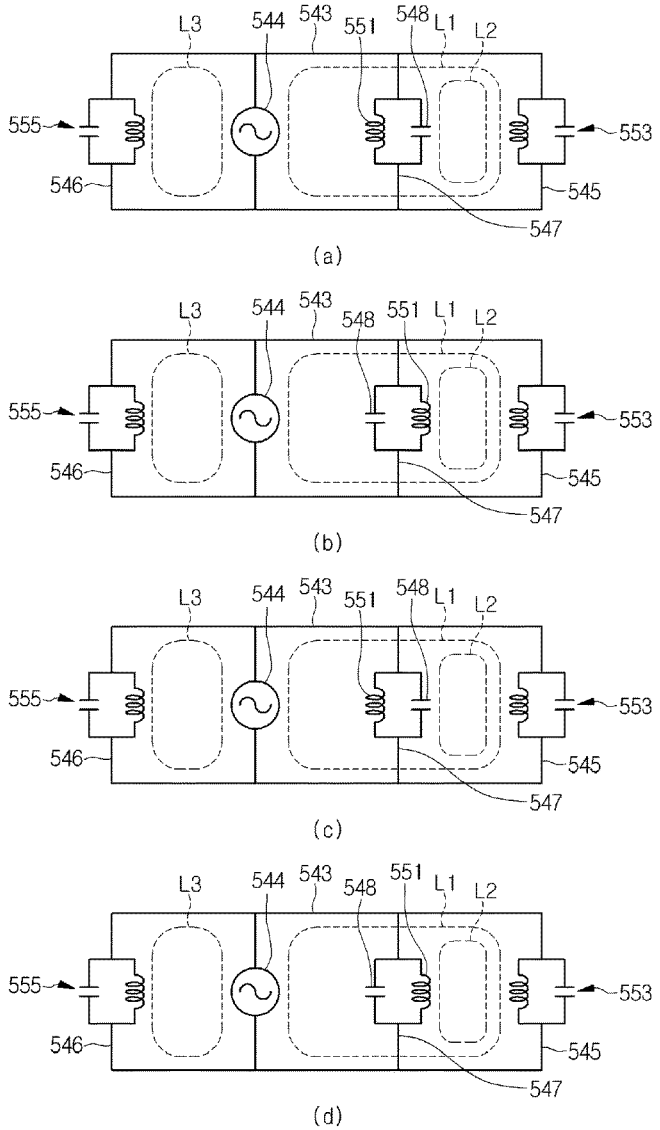
[Fig. 26]
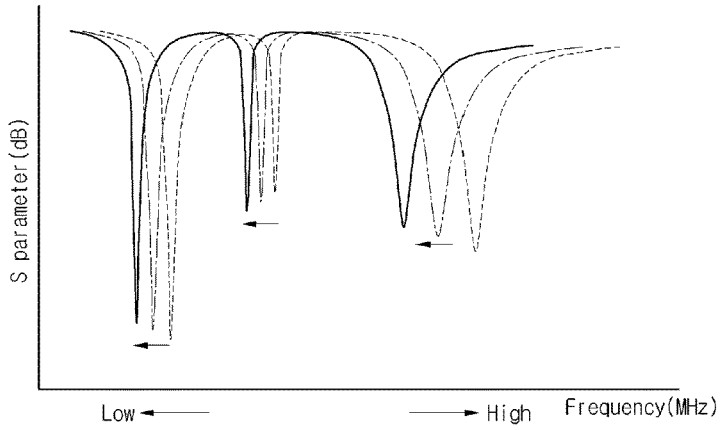

ELECTRICITY FEEDING STRUCTURE

CROSS-REFERENCE TO RELATED APPLICATIONS

This application is the U.S. national stage application of International Patent Application No. PCT/KR2014/002574, filed. Mar. 26, 2014, which claims priority to Korean Application Nos. 10-2013-0032091, filed Mar. 26, 2013, the disclosures of each of which are incorporated herein by reference in their entirety.

TECHNICAL FIELD

The present invention relates to a configuration of a communication terminal, and more particularly to a feeding structure of an antenna apparatus.

BACKGROUND ART

In general, a communication terminal includes an antenna apparatus to transceive an electromagnetic wave. The antenna apparatus makes a resonance in a specific frequency band to transceive the electromagnetic wave having the frequency band. In this case, when the antenna apparatus makes a resonance in the frequency band, impedance has an imaginary number. Further, an S parameter of the antenna apparatus is rapidly reduced in the frequency band.

To this end, the antenna apparatus includes a conducting wire having an electrical length of $\lambda/2$ in relation to a wavelength $\lambda$ corresponding to a desired resonance frequency band. The antenna apparatus transmits the electromagnetic wave through the conducting wire and the electromagnetic wave forms a standing wave in the conducting wire so that resonance is made in the antenna apparatus. In this case, the antenna apparatus may include a plurality of different conductive wires s to expand a resonance frequency band.

However, since the length of the conductive wire is determined depending on a resonance frequency band in the antenna apparatus, the size of the antenna apparatus is determined depending on the frequency band. Accordingly, as the resonance frequency band to be realized in the antenna apparatus is narrowed, the antenna apparatus may be enlarged. The enlargement of the antenna apparatus is more made as the number of conductive wires is increased. In other words, as the resonance frequency band is expanded in the antenna apparatus, the antenna apparatus may be enlarged.

DISCLOSURE

Technical Problem

Accordingly, an object of the present invention is to easily regulate a resonance frequency band in an antenna apparatus. In other words, according to the present invention, the resonance frequency band of the antenna apparatus can be regulated without the increase of the size of the antenna apparatus to a large size.

Technical Solution

In order to accomplish the object of the present invention, there is provided a feeding structure including a resonance unit including a feeding unit and a grounding unit connected with the feeding unit, a resonance adding unit between the feeding unit and the grounding unit, and a regulator in the feeding unit.

In the feeding structure according to the present invention, the regulator changes a resonance loop formed by the resonance unit.

Meanwhile, in order to accomplish the object of the present invention, there is provided a feeding structure including a resonance unit including a feeding unit and a grounding unit connected with the feeding unit, a resonance adding unit between the feeding unit and the grounding unit, and a regulator in the grounding unit.

In this case, in the feeding structure according to the present invention, the regulator includes a resonance loop formed by the grounding unit and the resonance adding unit.

Meanwhile, in order to accomplish the object of the present invention, there is provided a feeding structure including a resonance unit including a feeding unit and a grounding unit connected with the feeding unit, and a resonance adding unit interposed between the feeding unit and the grounding unit, and a regulator provided in the grounding unit.

In this case, in the feeding structure according to the present invention, the regulator includes a first resonance loop formed by the resonance unit and a second resonance loop formed by the grounding unit and the resonance adding unit.

In this case, in the feeding structure according to the present invention, the grounding unit may include first and second grounding units provided in opposition to each other about the feeding unit.

Further, in the feeding structure according to the present invention, the regulator may be provided in at least one of the first grounding unit and the second grounding unit.

Advantageous Effects

As described above, according to the present invention, the resonance frequency band of the antenna apparatus can be easily regulated. In other words, as the feeding structure includes the regulator, the resonance frequency band of the antenna apparatus can be easily regulated. In this case, in the feeding structure, at least one of resonance bands can be regulated based on the positions and the reactance of the feeding structure. Accordingly, the resonance frequency band can be regulated without the increase of the antenna apparatus to the large size.

DESCRIPTION OF DRAWINGS

FIG. 1 is an exploded perspective view showing an antenna apparatus according to the first embodiment of the present invention.

FIGS. 2 and 3 are circuit diagrams showing equivalent circuits of a feeding structure shown in FIG. 1 for an illustrative purpose.

FIG. 4 is a graph to explain an operating characteristic of the antenna apparatus according to the first embodiment of the present invention.

FIG. 5 is an exploded perspective view showing an antenna apparatus according to the second embodiment of the present invention.

FIG. 6 shows equivalent circuits of a feeding structure shown in FIG. 5 for an illustrative purpose.

FIG. 7 is a graph to explain an operating characteristic of the antenna apparatus according to the second embodiment of the present invention.

FIG. 8 is an exploded perspective view showing an antenna apparatus according to the third embodiment of the present invention.

FIGS. 9 and 10 are circuit diagrams showing equivalent circuits of a feeding structure shown in FIG. 8 for an illustrative purpose.

FIG. 11 is an exploded perspective view showing an antenna apparatus according to the fourth embodiment of the present invention.

FIGS. 12 to 17 are circuit diagrams showing equivalent circuits of a feeding structure shown in FIG. 11 for an illustrative purpose.

FIG. 18 is an exploded perspective view showing an antenna apparatus according to the fifth embodiment of the present invention.

FIGS. 19 to 25 are circuit diagrams showing equivalent circuits of a feeding structure shown in FIG. 18 for an illustrative purpose.

FIG. 26 is a graph to explain an operating characteristic of the antenna apparatus according to the fifth embodiment of the present invention.

BEST MODE

[Mode for Invention]

Hereinafter, the embodiments of the present invention will be described in more detail. In accompanying drawings, the same elements will be assigned with the same numeric numbers. In addition, the details of the generally-known technology that makes the subject matter of the present invention unclear will be omitted in the following description.

FIG. 1 is an exploded perspective view showing an antenna apparatus according to the first embodiment of the present invention. FIGS. 2 and 3 are circuit diagrams showing equivalent circuits of a feeding structure shown in FIG. 1 for an illustrative purpose. FIG. 4 is a graph to explain an operating characteristic of the antenna apparatus according to the first embodiment of the present invention.

Referring to FIG. 1, an antenna apparatus 100 according to the present embodiment includes a driving substrate 110, a grounding structure 120, an antenna device 130, and a mounting member 170.

The driving substrate 110 is provided for power feeding and support in the antenna apparatus 100. In this case, the driving substrate 110 may be a printed circuit board (PCB). The driving substrate 110 has a flat panel structure. In this case, the driving substrate 110 may be realized in the form of a single substrate, or may be realized by laminating a plurality of substrates.

In addition, the driving substrate 110 is embedded therein with a transmission line (not shown). The transmission line is connected with a control module (not shown) at one end portion thereof. In addition, an opposite end portion of the transmission line is exposed. In other words, the transmission line receives a signal from the control module and transmits the signal from the one end portion to the opposite end portion. In this case, the driving substrate 110 may be divided into a grounding area 111 and an antenna area 113. In this case, the transmission line may be exposed in the antenna area 113.

In addition, the driving substrate 110 includes a dielectric. In this case, the conductivity (σ) of the driving substrate 110 may be 0.02. Further, the permittivity (ε) of the driving substrate 110 may be 4.4. In addition, the loss tangent of the driving substrate 110 may be 0.02. In this case, the transmission line includes a conductive material. In this case, the transmission line may include at least one of silver (Ag), palladium (Pd), platinum (Pt), copper (Cu), gold (Au), and nickel (Ni).

The grounding structure 120 is provided to ground the antenna apparatus 100. The grounding structure 120 is formed in a portion or an entire portion of the driving substrate 110. The grounding structure 120 may be provided on at least one of a bottom surface or a top surface of the driving substrate 110. In addition, when the driving substrate 110 includes a plurality of substrates, the grounding structure 120 may be interposed between the substrates. In this case, the grounding structure 120 may be provided at the grounding area 111 of the driving substrate 110.

The antenna device 130 is provided in the antenna apparatus 100 to transceive a signal. In this case, the antenna device 130 operates at a resonance frequency band to transceive the signal. In this case, the antenna device 130 operates as a signal is supplied to the antenna device 130 from the driving substrate 110. In addition, the antenna device 130 makes a resonance at preset impedance.

In this case, the resonance frequency band of the antenna apparatus 100 includes a plurality of resonance bands. In other words, the resonance frequency band includes a first resonance frequency band f1 and a second resonance frequency band f2. In this case, the first resonance frequency band f1 may be lower than the second resonance frequency band f2. In addition, the second resonance frequency band f2 may be higher than the first resonance frequency band f1. In addition, the resonance frequency bands may be spaced apart from each other in a frequency domain. Accordingly, the resonance frequency band of the antenna device 130 may correspond to a multiple frequency band. Further, the resonance frequency bands may be coupled to each other in the frequency domain. Accordingly, the resonance frequency band of the antenna device 130 may correspond to a broad frequency band.

The antenna device 130 is provided in the driving substrate 110. In this case, the antenna device 130 may be provided on the driving substrate 110. In addition, the antenna device 130 makes contact with the transmission line. Further, the antenna device 130 makes contact with the grounding structure 120. In this case, the antenna device 130 includes a feeding structure 140 and a radiator 160.

The feeding structure 140 is provided to supply a signal in the antenna device 130. In other words, the feeding structure 140 operates the radiator 160. In addition, the feeding structure 140 operates together with the radiator 160. In this case, the feeding structure 140 supplies the signal to the radiator 160.

The feeding structure 140 is provided on the driving substrate 110. In this case, the feeding structure 140 may be attached to a top surface of the driving substrate 110. In addition, the feeding structure 140 makes contact with the transmission line. In this case, the feeding structure may be provided at the antenna area 113 of the driving substrate 110. In addition, the feeding structure 140 may make contact with the grounding structure 120. Accordingly, the signal is introduced into the grounding structure 120 from the feeding structure 140. In this case the feeding structure 140 includes a resonance unit 141, a resonance adding unit 147, and a regulator 150.

The resonance unit 141 determines the first resonance frequency band f1 of the resonance frequency band for the antenna device 130. The resonance unit 141 includes a feeding unit 143 and a grounding unit 145. The resonance unit 141 is formed by coupling the feeding unit 143 to the grounding unit 145. In this case, the resonance unit 141 may be expressed as a conductive wire as shown in FIGS. 2 and 3. In addition, in the resonance unit 141, the feeding unit 143 and the grounding unit 145 may form a loop.

The feeding unit 143 supplies a signal to the resonance unit 141. In other words, the feeding unit 143 makes contact with the transmission line of the driving substrate 110. In this case, one end portion of the feeding unit 143 makes contact with the transmission unit. In this case, one end portion of the feeding unit 143 is defined as a feeding point (FP) 144. For example, the feeding point 144 may make contact with the transmission line near the grounding structure 120. In other words, the feeding point 144 does not make contact with the grounding structure 120. Accordingly, the signal is supplied to the feeding unit 143 from the control module. In addition, the feeding unit 143 extends from the transmission line. In this case, the feeding unit 143 extends to an opposite end portion thereof. Accordingly, the signal is supplied from the one end portion of the feeding unit 143 to the opposite end portion of the feeding unit 143. In addition, the feeding unit 143 includes a conductive material. In this case, the feeding unit 143 may include at least one of Ag, Pd, Pt, Cu, Au, and Ni.

The grounding unit 145 grounds the resonance unit 141. In other words, the grounding unit 145 makes contact with the grounding structure 120. In this case, one end portion of the grounding unit 145 makes contact with the grounding structure 120. In this case, one end portion of the grounding unit 145 is defined as a grounding point. In addition, the grounding unit 145 extends from the grounding structure 120. In this case, the grounding structure 145 extends to an opposite end portion thereof. In this case, the grounding unit 145 makes contact with the feeding unit 143 through the opposite end portion thereof. Accordingly, the grounding unit 145 is grounded, and the signal is transmitted to the grounding unit 145 from the feeding unit 143. Further, the grounding unit 145 includes a conductive material. In this case, the grounding unit 145 may include at least one of Ag, Pd, Pt, Cu, Au, and Ni.

The resonance adding unit 147 adds a resonance band to a resonance frequency band of the antenna device 130. In other words, the resonance adding unit 147 determines the second resonance frequency band f2 of the resonance frequency band. The resonance adding unit 147 is interposed between the feeding unit 143 and the grounding unit 145 provided in the resonance unit 141. In this case, the resonance adding unit 147 is connected with the resonance unit 141. Further, the resonance adding unit 147 is connected with at least one of the feeding unit 143 and the grounding unit 145. Accordingly, the signal is introduced into the resonance unit 147 from the resonance unit 141.

In addition, the resonance adding unit 147 is connected with the grounding structure 120. In this case, one end portion of the resonance adding unit 147 is connected with the grounding structure 120. In detail, the resonance adding unit 147 may make contact with the grounding structure 120 through the one end portion thereof. In addition, the resonance adding unit 147 extends from the grounding structure 120. In this case, the resonance adding unit 147 extends from the grounding structure 120 to an opposite end portion thereof. In this case, the resonance adding unit 147 is connected with the resonance unit 141 through the opposite end portion thereof. Accordingly, the resonance adding unit 147 is grounded, and the signal is transmitted to the one end portion of the resonance adding unit 147 from the opposite end portion of the resonance adding unit 147. In addition, the resonance adding unit 147 includes a conductive material. In this case, the resonance adding unit 147 may include at least one of Ag, Pd, Pt, Cu, Au, and Ni.

In this case, the resonance adding unit 147 may be expressed as a conductive wire as shown in FIG. 2. In addition, the resonance adding unit 147 may include a reactance element 148 as shown in FIG. 3. In other words, the reactance element 148 may be provided on the conductive wire. The reactance element 148 regulates the resonance frequency band in the antenna device 130. In other words, the reactance element 148 regulates the electrical characteristic of the antenna device 130. In this case, the reactance element 148 regulates the second resonance frequency band of the resonance frequency band for the antenna device 130. In this case, the reactance element 148 has a preset reactance. In other words, the reactance element 148 regulates the electrical characteristic of the antenna device 130 based on the reactance. In this case, the reactance element 148 includes at least one of a capacitive element and an inductive element. For example, the capacitive element may be a capacitor. In addition, the inductive element may be an inductor.

The regulator 150 is provided to regulate the resonance frequency band in the antenna device 130. In other words, the regulator 150 regulates the electrical characteristic of the antenna device 130. In this case, the regulator 150 regulates at least one of the first resonance frequency band f1 and the second resonance frequency band f2 of the resonance frequency band of the antenna device 130. The regulator 150 is provided at the feeding unit 143. In this case, the regulator 150 may be interposed in the feeding unit 143. Accordingly, the signal is introduced into the regulator 150 from the feeding unit 143.

In addition, the regulator 150 includes the reactance element. In other words, the reactance element is provided at the feeding unit 143. In this case, the reactance element may be interposed in the feeding unit 143. In this case, the reactance element has a preset reactance. In other words, the reactance element regulates the electrical characteristic of the antenna device 130 based on the reactance. In this case, the reactance element includes at least one of a capacitive element and an inductive element. For example, the capacitive element may be a capacitor. In addition, the inductive element may be an inductor.

In this case, the regulator 150 may include an inductor or a capacitor as shown in FIGS. 2(*a*) and 2(*b*) and FIGS. 3(*a*) and 3(*b*). Meanwhile, the regulator 150 may include both of the inductor and the capacitor as shown in FIGS. 2(*c*), 2(*d*), 2(*e*), and 2(*f*) and FIGS. 3(*c*), 3(*d*), 3(*e*), and 3(*f*). In this case, as shown in FIGS. 2(*c*) and 2(*d*), and FIGS. 3(*c*) and 3(*d*), the inductor and the capacitor may be connected with each other in series. In addition, as shown in FIGS. 2(*e*) and 2(*f*) and FIGS. 3(*e*) and 3(*f*), the inductor and the capacitor may be connected with each other in parallel.

The radiator 160 is provided for the actual operation of the antenna device 130. In this case, the radiator 160 operates at the resonance frequency band. In other words, as the signal is supplied from the feeding structure 140, the radiator 160 operates. In addition, the radiator 160 and the feeding structure 140 operate together. The radiator 160 is coupled to the feeding structure 140. In this case, the radiator 150 is electrically connected with the resonance unit 141. In addition, the radiator 160 includes a contact part 161. In this case, the contact part 161 makes contact with the resonance unit 141. In this case, the contact part 161 may be formed in the type of a pin, or may be formed in the form of a C-clip.

In addition, the radiator 160 includes a conductive material. In this case, the radiator 160 may include at least one of Ag, Pd, Pt, Cu, Au, and Ni.

The mounting member 170 is provided to support the radiator 160 in the antenna apparatus 100. In other words, as the radiator 160 is mounted on the mounting member 170, the mounting member 170 supports the radiator 160. Although not shown, when the antenna apparatus 100 is mounted in a communication terminal (not shown), the mounting member 170 may be mounted on an inner surface of an external case in the communication terminal. In this case, the driving substrate 110 may be provided in the internal space of the communication terminal defined by the external case.

The mounting member 170 is provided corresponding to the driving substrate 110. In this case, the mounting member 170 is provided corresponding to the antenna area 113 of the driving substrate 110. In addition, the mounting member 170 is spaced apart from the driving substrate 110 or the feeding structure 140 by the contact part 161. In addition, the mounting member 170 includes a bottom surface 171, a top surface 173 corresponding to the bottom surface 171, and a side surface 175 to connect the bottom surface 171 with the top surface 173. In this case, the mounting member 170 may be mounted on the external case of the communication terminal through the top surface 173.

In this case, the radiator 160 may be mounted on the bottom surface 171 of the mounting member 170. Although not shown, the radiator 160 may be mounted on the top surface 173 of the mounting member 170. In this case, the radiator 160 may be interposed between the external case of the communication terminal and the mounting member 170. In addition, the radiator 160 may extend to the bottom surface 171 of the mounting member 170 to the side surface 175 of the mounting member 170. Meanwhile, the radiator 160 may extend to the bottom surface 171 through the mounting member 170. The contact part 161 of the radiator 160 may be provided in a space formed between the resonance unit 141 of the driving substrate 110 and the mounting member 170.

Accordingly, the feeding structure 140 and the radiator 160 operate together. In this case, if the signal from the driving substrate 110 is supplied, the feeding structure 140 transmits the signal. Then, the signal is supplied to the radiator 160 from the feeding structure 140. In this case, as shown in FIGS. 2 and 3, two loops of a first resonance loop L1 and a second resonance loop L2 are formed in the feeding structure 140.

The first resonance loop L1 is formed by the resonance unit 141. In other words, the first resonance loop L1 includes the feeding unit 143 and the grounding unit 145. In this case, the regulator 150 changes the first resonance loop L1. In other words, the first resonance loop L1 is changed based on the reactance of the regulator 150. The second resonance loop L2 is formed by the grounding unit 145 and the resonance adding unit 147. In other words, the second resonance loop L2 includes the grounding unit 145 and the resonance adding unit 147. In this case, when the resonance adding unit 147 includes the reactance element 148, the reactance element 148 may change the second resonance loop L2. In other words, the second resonance loop L2 may be changed based on the reactance of the reactance element 148.

In addition, the antenna apparatus 100 operates at a preset resonance frequency band. For example, the antenna apparatus 100 may have the same operating characteristic as that shown in FIG. 4. In other words, the antenna apparatus 100 makes a resonance at the first resonance frequency band f1 and the second resonance frequency band f2. In this case, the first resonance frequency band f1 is determined based on the first resonance loop L1. In other words, the first resonance frequency band f1 is determined based on the size of the first resonance loop L1. In addition, the second resonance frequency band f2 is determined based on the second resonance loop L2. In other words, the second resonance frequency band f2 is determined based on the size of the second resonance loop L2. In addition, when the resonance adding unit 147 includes the reactance element 148, the second resonance frequency band f2 may be regulated based on the reactance of the reactance element 148. In addition, the first resonance frequency band f1 and the second resonance frequency band f2 are regulated by the regulator 150. In other words, the first resonance frequency band f1 and the second resonance frequency band f2 are regulated based on the reactance of the regulator 150. In this case, the first and second resonance frequency bands f1 and f2 are regulated in the frequency domain.

FIG. 5 is an exploded perspective view showing an antenna apparatus according to the second embodiment of the present invention. FIG. 6 shows equivalent circuits of a feeding structure shown in FIG. 5 for an illustrative purpose. FIG. 7 is a graph to explain an operating characteristic of the antenna apparatus according to the second embodiment of the present invention.

Referring to FIG. 5, an antenna apparatus 200 according to the present embodiment includes a driving substrate 210, a grounding structure 220, an antenna device 230, and a mounting member 270. The antenna device 230 includes a feeding structure 240 and a radiator 260. In addition, the feeding structure 240 includes a resonance unit 241, a resonance adding unit 247, and a regulator 250. In this case, the resonance unit 241 includes a feeding unit 243 and a grounding unit 245. In this case, as shown in FIG. 6, the resonance unit 241 may extend to a feeding point 244 of the feeding unit 243, and may be expressed as a conductive wire. In addition, the resonance adding unit 247 may be expressed as shown in FIG. 6(*a*). In addition, the resonance adding unit 247 may include a reactance element 248 as shown in FIGS. 6(*b*), 6(*c*), 6(*d*), 6(*e*), and 6(*f*). In other words, the reactance element 248 may be provided on the conductive wire. Since each configuration of the present embodiment is similar to that of the previous embodiment described above, the details thereof will be omitted.

However, in the antenna apparatus 200 according to the present embodiment, the regulator 250 is provided in the resonance adding unit 247. In this case, the regulator 250 may be interposed in the resonance adding unit 247. Accordingly, the signal is introduced into the regulator 250 from the feeding unit 243.

In addition, the regulator 250 includes a reactance element. In other words, the reactance element is provided in the resonance adding unit 247. In this case, the reactance element may be interposed in the resonance adding unit 247. The reactance element has preset reactance. In other words, the reactance element adjusts the electrical characteristic of the antenna device 230 based on the reactance of the reactance element. In this case, the reactance element includes at least one of a capacitive element and an inductive element. For example, the capacitive element may be a capacitor, and the inductive element may be an inductor.

In this case, as shown in FIG. 6(*a*), the regulator 250 may be provided in the conductive wire corresponding to the resonance adding unit 247. Meanwhile, when the resonance adding unit 247 includes the reactance element 248, the regulator 250 may be connected with the reactance element 248 as shown in FIGS. 6(*b*), 6(*c*), 6(*d*), 6(*e*), and 6(*f*). In this case, as shown in FIGS. 6(*b*), 6(*c*), and 6(*d*), the regulator 250 may be connected with at least one of both end portions of the reactance element 248 in series. In addition, as shown in FIGS. 6(*e*) and 6(*f*), the regulator 250 may be connected with the reactance element 248 in parallel.

Accordingly, the feeding structure 240 and the radiator 260 operate together. In this case, if a signal is supplied to the feeding structure 240 from the driving substrate 210, the signal is transmitted from the feeding structure 240. In detail, the signal is supplied to the radiator 260 from the feeding structure 240. In this case, as shown in FIG. 6, two resonance loops, that is, the first and second resonance loops L1 and L2 are formed in the feeding structure 240.

The first resonance loop L1 is formed by the resonance unit 241. In other words, the first resonance loop L1 includes the feeding unit 243 and the grounding unit 245. The second resonance loop L2 is formed by the grounding unit 245 and the resonance adding unit 247. In other words, the second resonance loop L2 includes the grounding unit 245 and the resonance adding unit 247. In this case, if the resonance adding unit 247 includes the reactance element 248, the reactance element 248 may change the second resonance loop L2. In other words, the second resonance loop L2 may be changed based on the reactance of the reactance element 248. In addition, the regulator 250 changes the second resonance loop L2. In other words, the second resonance loop L2 is changed based on the reactance of the regulator 250.

In addition, the antenna apparatus 200 operates at a preset resonance frequency band. For example, the antenna apparatus 200 may have the same operating characteristic as that shown in FIG. 7. In other words, the antenna apparatus 200 makes a resonance at the first and second resonance frequency bands f1 and f2. In this case, the first resonance frequency band f1 is determined based on the first resonance loop L1. In other words, the first resonance frequency band f1 is determined based on the size of the first resonance loop L1. In addition, the second resonance frequency band f2 is determined based on the second resonance loop L2. In other words, the second resonance frequency band f2 is determined based on the size of the second resonance loop L2. In this case, if the resonance adding unit 247 includes the reactance element 248, the second resonance frequency band f2 may be regulated based on the reactance of the reactance element 248. In addition, the second resonance frequency band f2 is regulated by the regulator 250. In other words, the second resonance frequency band f2 is regulated based on the reactance of the regulator 250. In this case, the second resonance frequency band f2 is regulated in a frequency domain.

FIG. 8 is an exploded perspective view showing an antenna apparatus according to the third embodiment of the present invention. FIGS. 9 and 10 are circuit diagrams showing equivalent circuits of a feeding structure shown in FIG. 8 for an illustrative purpose.

Referring to FIG. 8, an antenna apparatus 300 according to the present embodiment includes a driving substrate 310, a grounding structure 320, an antenna device 330, and a mounting member 370. In addition, the antenna device 330 includes a feeding structure 340 and a radiator 360. In addition, the feeding structure 340 includes a resonance unit 341, a resonance adding unit 347, and a regulator 350. In this case, the resonance unit 341 includes a feeding unit 343 and a grounding unit 345. In this case, the resonance unit 341 may extend to a feeding point 344 of the feeding unit 343 as shown in FIGS. 9 and 10, and may be expressed as a conductive wire. In addition, as shown in FIG. 9, the resonance adding unit 347 may be expressed as a conductive wire. In addition, as shown in FIG. 10, the resonance adding unit 347 may include a reactance element 348. In other words, the reactance element 348 may be provided on the conductive wire. Since each configuration of the present embodiment is similar to that of the previous embodiment described above, the details thereof will be omitted.

However, in the antenna apparatus 300 according to the present embodiment, the regulator 350 is provided on the grounding unit 345. In this case, the regulator 350 may be interposed in the grounding unit 345. Accordingly, a signal is introduced into the regulator 350 from the feeding unit 343.

In addition, the regulator 350 includes a reactance element. In other words, the reactance element is provided in the grounding unit 345. In this case, the reactance element may be interposed in the grounding unit 345. In this case, the reactance element has preset reactance. In other words, the reactance element regulates the electrical characteristic of the antenna device 330 based on the reactance. In this case, the reactance element includes at least one of a capacitive element and an inductive element. For example, the capacitive element may be a capacitor. In addition, the inductive element may be an inductor.

In this case, the regulator 350 may include an inductor or a capacitor as shown in FIGS. 9(*a*) and 9(*b*) and FIGS. 10(*a*) and 10(*b*). Meanwhile, the regulator 350 may include both of the inductor and the capacitor as shown in FIGS. 9(*c*), 9(*d*), 9(*e*), and 9(*f*) and FIGS. 10(*c*), 10(*d*), 10(*e*), and 10(*f*). In this case, as shown in FIGS. 9(*c*) and 9(*d*), and FIGS. 10(*c*) and 10(*d*), the inductor and the capacitor may be connected with each other in series. In addition, as shown in FIGS. 9(*e*) and 9(*f*) and FIGS. 10(*e*) and 10(*f*), the inductor and the capacitor may be connected with each other in parallel.

Accordingly, the feeding structure 340 and the radiator 360 operate together. In this case, if a signal is supplied to the feeding structure 340 from the driving substrate 310, the signal is transmitted from the feeding structure 340. In detail, the signal is supplied to the radiator 360 from the feeding structure 340. In this case, as shown in FIGS. 9 and 10, two resonance loops, that is, the first and second resonance loops L1 and L2 are formed in the feeding structure 340.

The first resonance loop L1 is formed by the resonance unit 341. In other words, the first resonance loop L1 includes the feeding unit 343 and the grounding unit 345. The second resonance loop L2 is formed by the grounding unit 345 and the resonance adding unit 347. In other words, the second resonance loop L2 includes the grounding unit 345 and the resonance adding unit 347. In this case, if the resonance adding unit 347 includes the reactance element 348, the reactance element 348 may change the second resonance loop L2. In other words, the second resonance loop L2 may be changed based on the reactance of the reactance element 348. In addition, the regulator 350 changes the first resonance loop L1 and the second resonance loop L2. In other words, the first resonance loop L1 and the second resonance loop L2 are changed based on the reactance of the regulator 350.

In addition, the antenna apparatus 300 operates at a preset resonance frequency band. For example, the antenna apparatus 300 may have the same operating characteristic as that shown in FIG. 4, similarly to the previous embodiment described above. In other words, the antenna apparatus 300 makes a resonance at the first and second resonance frequency bands f1 and f2. In this case, the first resonance frequency band f1 is determined based on the first resonance loop L1. In other words, the first resonance frequency band f1 is determined based on the size of the first resonance loop L1. In addition, the second resonance frequency band f2 is determined based on the second resonance loop L2. In other words, the second resonance frequency band f2 is determined based on the size of the second resonance loop L2. In this case, if the resonance adding unit 347 includes the reactance element 348, the second resonance frequency band f2 may be regulated based on the reactance of the reactance element 348. In addition, the first and second resonance frequency bands f1 and f2 are regulated by the regulator 350. In other words, the first and second resonance frequency bands f1 and f2 are regulated based on the reactance of the regulator 350. In this case, the first and second resonance frequency bands f1 and f2 are regulated in a frequency domain.

FIG. 11 is an exploded perspective view showing an antenna apparatus according to the fourth embodiment of the present invention. FIGS. 12 to 17 are circuit diagrams showing equivalent circuits of a feeding structure shown in FIG. 11 for an illustrative purpose.

Referring to FIG. 11, an antenna apparatus 400 according to the present embodiment includes a driving substrate 410, a grounding structure 420, an antenna device 430, and a mounting member 470. The antenna device 430 includes a feeding structure 440 and a radiator 460. In addition, the feeding structure 440 includes a resonance unit 441, a resonance adding unit 447, and a regulator 450. In this case, the resonance unit 441 includes a feeding unit 443 and a grounding unit 445. In this case, as shown in FIGS. 12 to 17, the resonance unit 441 may extend to a feeding point 444 of the feeding unit 443, and may be expressed as a conductive wire. In addition, the resonance adding unit 447 may be expressed as a conductive wire as shown in FIG. 12. In addition, the resonance adding unit 447 may include a reactance element 448 as shown in FIGS. 13 to 17. In other words, the reactance element 448 may be provided on the conductive wire. Since each configuration of the present embodiment is similar to that of the previous embodiment described above, the details thereof will be omitted.

However, in the antenna apparatus 400 according to the present embodiment, the regulator 450 is provided in both of the resonance adding unit 447 and the grounding unit 445. In this case, the regulator 450 includes a first regulator 451 and a second regulator 453. In addition, the first regulator 451 is provided in the resonance adding unit 447, and the second regulator 453 is provided in the grounding unit 445. In this case, the first regulator 451 may be interposed in the resonance adding unit 447, and the second regulator 453 may be interposed in the grounding unit 445. Accordingly, a signal is introduced into the regulator 450 from the feeding unit 443.

In addition, the first regulator 451 includes a reactance element. In other words, the reactance element of the first regulator 451 is provided in the resonance adding unit 447. In this case, the reactance element of the first regulator 451 may be interposed in the resonance adding unit 447. In this case, the reactance element of the first regulator 451 has preset reactance. In other words, the reactance element of the first regulator 451 regulates the electrical characteristic of the antenna device 440 based on the reactance. In this case, the reactance element of the first regulator 451 includes at least one of a capacitive element and an inductive element. For example, the capacitive element may be a capacitor, and the inductive element may be an inductor.

In this case, the first regulator 451 may be provided on a conductive wire corresponding to the resonance adding unit 447 as shown in FIG. 12. Meanwhile, if the resonance adding unit 447 includes the reactance element 448, the first regulator 451 may be connected with the reactance element 448 as shown in FIGS. 13 to 17. In this case, as shown in FIGS. 13 to 15, the first regulator 451 may be connected with at least one of both end portions of the reactance element 448 in series. In addition, as shown in FIGS. 16 and 17, the first regulator 451 may be connected with the reactance element 448 in parallel.

In addition, the second regulator 453 includes a reactance element. In other words, the reactance element of the second regulator 453 is provided in the grounding unit 445. In this case, the reactance element of the second regulator 453 may be interposed in the grounding unit 445. In this case, the reactance element of the second regulator 453 has preset reactance. In other words, the reactance element of the second regulator 453 regulates the electrical characteristic of the antenna device 430 based on reactance. In this case, the reactance element of the second regulator 453 includes at least one of a capacitive element and an inductive element. For example, the capacitive element may be a capacitor. In addition, the inductive element may be an inductor.

In this case, the second regulator 453 may include an inductor or a capacitor as shown in FIGS. 12(*a*) and (b) and FIGS. 17(*a*) and 17(*b*). Meanwhile, the second regulator 453 may include both of an inductor and a capacitor as shown in FIGS. 12(*c*), 12(*d*), 12(*e*), and 12(*f*) and FIGS. 17(*c*), 17(*d*), 17(*e*), and 17(*f*). In this case, as shown in FIGS. 12(*c*) and 12(*d*) and FIGS. 17(*c*) and 17(*d*), the inductor may be connected with the capacitor in series. In addition, as shown in FIGS. 12(*e*) and 12(*f*) and FIGS. 17(*e*) and 17(*f*), the inductor may be connected with the capacitor in parallel.

Accordingly, the feeding structure 440 and the radiator 460 operate together. In this case, if the signal from the driving substrate 410 is supplied, the feeding structure 440 transmits the signal. Then, the signal is supplied to the radiator 460 from the feeding structure 440. In this case, as shown in FIGS. 12 to 17, two loops of a first resonance loop L1 and a second resonance loop L2 are formed in the feeding structure 440.

The first resonance loop L1 is formed by the resonance unit 441. In other words, the first resonance loop L1 includes the feeding unit 443 and the grounding unit 445. The second resonance loop L2 is formed by the grounding unit 445 and the resonance adding unit 447. In other words, the second resonance loop L2 includes the grounding unit 445 and the resonance adding unit 447. In this case, when the resonance adding unit 447 includes the reactance element 448, the reactance element 448 may change the second resonance loop L2. In other words, the second resonance loop L2 may be changed based on the reactance of the reactance element 448. In addition, the regulator 450 changes the first resonance loop L1 and the second resonance loop L2. In this case, the first regulator 451 changes the second resonance loop L2. In other words, the second resonance loop L2 is changed based on the reactance of the first regulator 451. In addition, the second regulator 453 changes the first resonance loop L1 and the second resonance loop L2. In other words, the first resonance loop L1 and the second resonance loop L2 are changed based on the reactance of the second regulator 453.

In addition, the antenna apparatus 400 operates at a preset resonance frequency band. For example, the antenna apparatus 400 may have the same operating characteristic as that shown in FIG. 4, similarly to the previous embodiment described above. In other words, the antenna apparatus 400 makes a resonance at the first and second resonance frequency band f1 and f2. In this case, the first resonance frequency band f1 is determined based on the first resonance loop L1. In other words, the first resonance frequency band f1 is determined based on the size of the first resonance loop L1. In addition, the second resonance frequency band f2 is determined based on the second resonance loop L2. In other words, the second resonance frequency band f2 is determined based on the size of the second resonance loop L2. In this case, when the resonance adding unit 447 includes the reactance element 448, the second resonance frequency band f2 may be regulated based on the reactance of the reactance element 448. In addition, the first and second resonance frequency bands f1 and f2 are regulated by the regulator 450. In this case, the first and second resonance frequency bands f1 and f2 are regulated in the frequency domain. In other words, the second resonance frequency band f2 is regulated based on the reactance of the first regulator 451. In addition, the first and second resonance frequency bands f1 and f2 are regulated based on reactance.

Meanwhile, although the regulator 450 is provided in the resonance adding unit 447 and the grounding unit 445 according to the present embodiment for the illustrative purpose, the present invention is not limited thereto. In other words, the present invention may be realized by providing the regulator 450 on at least two of the feeding unit 443, the grounding unit 445, and the resonance adding unit 447.

For example, the regulator 450 may be provided at the resonance adding unit 447 and the feeding unit 443. In this case, the first regulator 451 may be provided at the resonance adding unit 447 and the second regulator 453 may be provided at the feeding unit 443. In addition, the first regulator 451 may include an inductor or a capacitor, or may include both of an inductor and a capacitor. In this case, the inductor may be connected with the capacitor in series or in parallel. In addition, the first regulator 451 may be provided in at least one of both end portions of the reactance element 448 in the resonance adding unit 447. In addition, the second regulator 453 may include an inductor or a capacitor, or may include both of the inductor and the capacitor. In addition, the inductor and the capacitor may be connected with each other in series or in parallel.

Accordingly, the first resonance frequency band f1 is determined based on the first resonance loop L1, and the second resonance frequency band f2 is determined based on the second resonance loop L2. In addition, the first and second resonance frequency bands f1 and f2 are regulated by the regulator 450. In this case, the first and second resonance frequency bands f1 and f2 are regulated in the frequency domain. In other words, the second resonance frequency band f2 is regulated based on the reactance of the first regulator 451. In addition, the first and second resonance frequency bands f1 and f2 are regulated based on the reactance of the second regulator 453

In addition, the regulator 450 may be provided at the feeding unit 443 and the grounding unit 445. Accordingly, the first regulator 451 may be provided at the feeding unit 443, and the second regulator 453 may be provided at the grounding unit 445. In addition, the first regulator 451 may include an inductor or a capacitor, or may include both of the inductor and the capacitor. In addition, the inductor may be connected with the capacitor in series or in parallel. In addition, the second regulator 453 may include an inductor or a capacitor, or may both of the inductor and the capacitor. In this case, the inductor may be connected with the capacitor in series or in parallel.

Accordingly, the first resonance frequency band f1 is determined based on the first resonance loop L1, and the second resonance frequency band f2 is determined based on the second resonance loop L2. In addition, the first resonance frequency band f1 and the second resonance frequency band f2 are regulated by the regulator 450. In this case, the first and second resonance frequency bands f1 and f2 are regulated in the frequency domain. In other words, the first and second resonance frequency bands f1 and f2 are regulated based on the reactance of the first and second regulators 451 and 453.

FIG. 18 is an exploded perspective view showing an antenna apparatus according to the fifth embodiment of the present invention. FIGS. 19 to 25 are circuit diagrams showing equivalent circuits of a feeding structure shown in FIG. 18 for an illustrative purpose. FIG. 26 is a graph to explain an operating characteristic of the antenna apparatus according to the fifth embodiment of the present invention.

Referring to FIG. 18, an antenna apparatus 500 according to the present embodiment includes a driving substrate 510, a grounding structure 520, an antenna device 530, and a mounting member 570. In addition, the antenna device 530 includes a feeding structure 540 and a radiator 560. In addition, the feeding structure 540 includes a resonance unit 541, a resonance adding unit 547, and a regulator 550. In this case, the resonance unit 541 includes a feeding unit 343 and a grounding unit 345. In this case, the resonance unit 541 may extend to a feeding point 5344 of the feeding unit 543 as shown in FIGS. 19 and 25, and may be expressed as a conductive wire. In addition, as shown in FIGS. 19 to 25, the resonance adding unit 547 may include a reactance element 548. In other words, the reactance element 548 may be provided on the conductive wire. Since each configuration of the present embodiment is similar to a relevant configuration of the previous embodiment described above, the details thereof will be omitted.

However, in the antenna apparatus 500 according to the present embodiment, a resonance frequency band of the antenna device 530 includes a first resonance frequency band f1, a second resonance frequency band f2, and a third resonance frequency band f3. In this case, the first resonance frequency band f1 may correspond to a lower frequency when comparing with the second and third resonance frequency bands f2 and f3. In addition, the second resonance frequency band f2 may correspond to a higher frequency when comparing with the first resonance frequency band f1 and the third resonance frequency band f3. In other words, the third resonance frequency band f3 may correspond to a higher frequency when comparing with the first resonance frequency band f1, and may correspond to a lower frequency when comparing with the second resonance frequency band f2. In addition, the first resonance frequency band f1, the second resonance frequency band f2, and the third resonance frequency band f3 may be spaced apart from each other in the frequency domain. In addition, at least two of the first to third resonance frequency bands f1, f2, and f3 may be coupled to each other in a frequency domain. Accordingly, the resonance frequency band of the antenna device 330 may correspond to a multiple frequency band, and may correspond to a broad frequency band.

To this end, in the antenna device 500 according to the present embodiment, the resonance unit 541 includes the feeding unit 543, the first grounding unit 545, and the second grounding unit 546. In this case, the feeding unit 543 is interposed between the first grounding unit 545 and the second grounding unit 546. In other words, the first and second grounding units 545 and 546 face each other about the feeding unit 543. The resonance unit 541 is formed by coupling the feeding unit 543, the first grounding unit 545, and the second grounding unit 546 together. In this case, as shown in FIGS. 19 to 25, the resonance unit 541 may be expressed as a conductive wire. Further, in the resonance unit 541, the feeding unit 543 and the first grounding unit 545 may constitute an individual loop, and the feeding unit 543 and the second grounding unit 546 may constitute an individual loop.

The feeding unit 543 supplies a signal to the resonance unit 541. In other words, the feeding unit 543 makes contact with the transmission line of the driving substrate 510. In this case, the feeding unit 543 makes contact with the transmission line through one end portion thereof. In this case, one end portion of the feeding unit 543 is defined as the feeding point 544. For example, the feeing point 544 may make contact with the transmission line near the grounding structure 520. In other words, the feeding point 544 does not make contact with the grounding structure 520. Accordingly, the signal is supplied to the feeding unit 543 from the control module. In addition, the feeding unit 543 extends from the transmission line. In this case, the feeding unit 543 extends to an opposite end portion thereof. Accordingly, the signal is supplied from one end portion of the feeding unit 543 to the opposite end portion of the feeding unit 543. In addition, the feeding unit 543 includes a conductive material. In this case, the feeding unit 543 may include at least one of Ag, Pd, Pt, Cu, Au, and Ni.

The first grounding unit 545 grounds the resonance unit 541. In other words, the first grounding unit 545 makes contact with the grounding structure 520. In this case, one end portion of the first grounding unit 545 may make contact with the grounding structure 520 through one end portion thereof. In addition, the first grounding unit 545 extends from the grounding structure 520. In this case, the first grounding unit 545 extends to an opposite end portion thereof. In this case, the first grounding unit 545 makes contact with the feeding unit 543 through the opposite end portion thereof. Accordingly, the first grounding unit 545 is grounded, and the signal is transmitted from the feeding unit 543 to the first grounding unit 545. In addition, the first grounding unit 545 includes a conductive material. In this case, the first grounding unit 545 may include at least one of Ag, Pd, Pt, Cu, Au, and Ni.

The second grounding unit 546 grounds the resonance unit 541, separately from the first grounding unit 545. In other words, the second grounding unit 546 makes contact with the grounding structure 520. In this case, one end portion of the second grounding unit 546 makes contact with the grounding structure 520. In addition, an opposite end portion of the second grounding unit 546 makes contact with the feeding unit 543. Accordingly, the second grounding unit 546 is grounded, and a signal is transmitted from the feeding unit 543 to the second grounding unit 546. In addition, the second grounding unit 546 includes a conductive material. In this case, the second grounding unit 546 may include at least one of Ag, Pd, Pt, Cu, Au, and Ni.

Further, in the antenna apparatus 500 according to the present embodiment, the regulator 550 is provided at the resonance adding unit 547 and the first grounding unit 545 as shown in FIG. 19. In this case, the regulator 550 includes a first regulator 551 and a second regulator 553. In addition, the first regulator 551 is provided at the resonance adding unit 547, and the second regulator 553 is provided at the first grounding unit 545. In this case, the first regulator 551 may be provided at the resonance adding unit 547, and the second regulator 553 may be provided at the first grounding unit 545. Accordingly, the signal is introduced into the regulator 550 from the feeding unit 543.

In addition, the first regulator 551 includes a reactance element. In other words, the reactance element of the first regulator 551 is provided at the resonance adding unit 547. In this case, the reactance element of the first regulator 551 may be interposed in the resonance adding unit 547. In this case, the reactance element of the first regulator 551 has preset reactance. In other words, the reactance element of the first regulator 551 regulates the electrical characteristic of the antenna device 530 based on the reactance. In this case, the reactance element of the first regulator 551 includes at least one of a capacitive element and an inductive element. For example, the capacitive element may be a capacitor. In addition, the inductive element may be an inductor.

In this case, the first regulator 551 may be provided at a conductive wire corresponding to the resonance adding unit 547. Meanwhile, when the resonance adding unit 547 includes a reactance element 548, the first regulator 551 may be connected with the reactance element 548. In addition, the first regulator 551 may be connected with at least one of both end portions of the reactance element 548 in series. In addition, the first regulator 551 may be connected with the reactance element 548 in parallel.

In addition, the regulator 553 includes a reactance element. In other words, the reactance element of the second regulator 553 is provided at the first grounding unit 545. In this case, the reactance element of the second regulator 553 may be interposed in the first grounding unit 545. In this case, the reactance element of the second regulator 553 has preset reactance. In other words, the reactance element of the second regulator 553 regulates the electrical characteristic of the antenna device 530 is regulated based on the reactance. In this case, the reactance element of the second regulator 553 includes at least one of a capacitive element and an inductive element. For example, the capacitive element may be a capacitor. In addition, the inductive element may be an inductor.

In this case, the second regulator 553 may include an inductor or a capacitor. Meanwhile, the second regulator 553 may include both of the inductor and the capacitor. In addition, the inductor and the capacitor may be connected with each other in series. In addition, the inductor and the capacitor may be connected with each other in parallel.

Meanwhile, as shown in FIGS. 20 to 25, in the antenna apparatus according to the present embodiment, the regulator 550 may be provided at a second grounding unit 546, as well as the resonance adding unit 547 and the first grounding unit 545. The regulator 550 may further include a third regulator 555 as well as a first regulator 551 and a second regulator 553. In addition, the third regulator 555 may be provided at the second grounding unit 546. In this case, the third regulator 555 may be interposed at the second grounding unit 546. Accordingly, the signal may be introduced into the third regulator 555 from the feeding unit 543.

In addition, the third regulator 555 includes a reactance element. In other words, the reactance element of the third regulator 555 is provided at the second grounding unit 546. In this case, the reactance element of the third regulator 555 may be interposed in the second grounding unit 546. In this case, the reactance element of the third regulator 555 has preset reactance. In other words, the reactance element of the third regulator 555 regulates the electrical characteristic of the antenna device 530 based on the reactance. In this case, the reactance element of the third regulator 555 includes at least one of at least one of a capacitive element and an inductive element. For example, the capacitive element may be a capacitor. In addition, the inductive element may be an inductor.

In this case, the third regulator 555 may include an inductor or a capacitor as shown in FIGS. 20 and 21. Meanwhile, the third regulator 555 may include both of an inductor and a capacitor as shown in FIGS. 22 to 25. In this case, as shown in FIGS. 22 and 23, the inductor and the capacitor may be connected with each other in series. In addition, as shown in FIGS. 24 and 25, the inductor may be connected with the capacitor in parallel.

Accordingly, the feeding structure 540 and the radiator 560 operate together. In this case, if the signal from the driving substrate 510 is supplied, the feeding structure 540 transmits the signal. Then, the signal is supplied to the radiator 560 from the feeding structure 540. In this case, as shown in FIGS. 19 and 25, three resonance loops of a first resonance loop L1, a second resonance loop L2, and a third resonance loop L3 are formed in the feeding structure 540.

In this case, the first resonance loop L1 and the third resonance loop L3 are formed by the resonance unit 541. In this case, the first resonance loop L1 includes the feeding unit 543 and the first grounding unit 545. In addition, the third resonance loop L3 includes the feeding unit 543 and the second grounding unit 546. The second resonance loop L2 is formed by the first grounding unit 545 and the resonance adding unit 547. In other words, the second resonance loop L2 includes the first grounding unit 545 and the resonance adding unit 547. In this case, when the resonance adding unit 547 includes the reactance element 548, the reactance element 548 may change the second resonance loop L2. In other words, the second resonance loop L2 may be changed based on the reactance of the reactance element 548.

In addition, the regulator 550 changes the first resonance loop L1, the second resonance loop L2, and the third resonance loop L3. In this case, the first regulator 551 changes the second resonance loop L2. In other words, the second resonance loop L2 is changed based on the reactance of the first regulator 551. In addition, the second regulator 553 changes the first resonance loop L1 and the second resonance loop L2. In other words, the first and second resonance loops L1 and L2 are changed based on the reactance of the second regulator 553. In addition, the third regulator 555 changes the third resonance loop L3. In other words, the third resonance loop L3 is changed based on the reactance of the third regulator 555.

In addition, the antenna apparatus 500 operates at a preset resonance frequency band. For example, the antenna apparatus 500 may have the same operating characteristic as that shown in FIG. 26. In other words, the antenna apparatus 500 makes a resonance at first, second, and third resonance frequency bands f1, f2, and f3. In this case, the first resonance frequency band f1 is determined based on the first resonance loop L1. In other words, the first resonance frequency band f1 is determined based on the size of the first resonance loop L1. In addition, the second resonance frequency band f2 is determined based on the second resonance loop L2. In other words, the second resonance frequency band f2 is determined based on the size of the second resonance loop L2. In this case, when the resonance adding unit 547 includes the reactance element 548, the second resonance frequency band f2 may be regulated based on the reactance of the reactance element 548. In addition, the third resonance frequency band f3 is determined based on the third resonance loop L3. In other words, the third resonance frequency band f3 is determined based on the size of the third resonance loop L3.

In addition, the first, second, and third resonance frequency bands f1, f2, and f3 are regulated by the regulator 550. In this case, the first and second resonance frequency bands f1 and f2 are regulated in the frequency domain. In other words, the second resonance frequency band f2 is regulated based on the reactance of the first regulator 551. In addition, the first and second resonance frequency bands f1 and f2 are regulated based on reactance of the second regulator 553. In addition, the third resonance frequency band f3 is adjusted based on the reactance of the third regulator 555.

Meanwhile, although the first and second regulators 551 and 553 are provided in the resonance adding unit 547 and the grounding unit 545, respectively, according to the present embodiment for the illustrative purpose, the present invention is not limited thereto. In other words, the present invention may be realized by separately providing the first and second regulators 551 and 553 in at least two of the feeding unit 543, the grounding unit 545, and the resonance adding unit 547.

For example, the first and second regulators 551 and 553 may be provided at the resonance adding unit 547 and the feeding unit 543. In this case, the first regulator 551 may be provided at the resonance adding unit 547, and the second regulator 553 may be provided at the feeding unit 543. In addition, the first regulator 551 may include an inductor or a capacitor, or may include both of an inductor and a capacitor. In this case, the inductor may be connected with the capacitor in series or in parallel. In addition, the first regulator 551 may be provided in at least one of both end portions of the reactance element 548 in the resonance adding unit 547. In addition, the second regulator 553 may include an inductor or a capacitor, or may include both of the inductor and the capacitor. In addition, the inductor and the capacitor may be connected with each other in series or in parallel.

Accordingly, the first resonance frequency band f1 is determined based on the first resonance loop L1, and the second resonance frequency band f2 is determined based on the second resonance loop L2. In addition, the first and second resonance frequency bands f1 and f2 are regulated by the regulator 550. In this case, the first and second resonance frequency bands f1 and f2 are regulated in the frequency domain. In other words, the second resonance frequency band f2 is regulated based on the reactance of the first regulator 551. In addition, the first and second resonance frequency bands f1 and f2 are regulated based on the reactance of the second regulator 453

In addition, the first and second regulators 551 and 553 may be provided at the feeding unit 543 and the grounding unit 545. Accordingly, the first regulator 551 may be provided at the feeding unit 543, and the second regulator 553 may be provided at the grounding unit 545. In addition, the first regulator 551 may include an inductor or a capacitor, or may include both of the inductor and the capacitor. In addition, the inductor may be connected with the capacitor in series or in parallel.

Accordingly, the first resonance frequency band f1 is determined based on the first resonance loop L1, and the second resonance frequency band f2 is determined based on the second resonance loop L2. In addition, the first and second resonance frequency bands f1 and f2 are regulated by the regulator 550. In this case, the first and second resonance frequency bands f1 and f2 are regulated in the frequency domain. In other words, the first and second resonance frequency bands f1 and f2 are regulated based on the reactance of the first and second regulators 551 and 553.

According to the present invention, the resonance frequency bands of the antenna apparatuses 100, 200, 300, 400, and 500 can be easily regulated. In other words, as the feeding structures 140, 240, 340, 440, and 540 include regulators 150, 250, 350, 450, and 550, the resonance frequency bands of the antenna apparatuses 100, 200, 300, 400, and 500 can be easily regulated. In the feeding structures 140, 240, 340, 440, and 540, at least one of the resonance bands can be regulated based on the positions and reactance of the regulators 150, 250, 350, 450, and 550. Accordingly, the resonance frequency bands may be regulated without the increase of the size of the antenna apparatuses 100, 200, 300, 400, and 500 to a large size.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims

The invention claimed is:

1. A feeding structure comprising:

a resonance unit comprising a feeding unit, a first grounding unit and a second grounding unit provided on opposite sides of the feeding unit;

a resonance adding unit provided between the feeding unit and the first grounding unit, comprising a first reactance element and being connected with the first grounding unit; and a regulator comprising second and third reactance elements, a first regulator unit, a second regulator unit connected with the first grounding unit, and a third regulator unit connected with the second grounding unit; wherein the first and second reactance elements each comprises an inductor and a capacitor connected in parallel, and the capacitor being connected with two end portions of the inductor, wherein the third reactance element comprises another inductor and another capacitor connected in series or in parallel, wherein a first resonance loop is formed by the feeding unit and the first grounding unit and a second resonance loop is formed by the first grounding unit and the resonance adding unit, and wherein the first resonance loop is adjusted by the regulator and the second resonance loop is adjusted by the first reactance element of the resonance adding unit.

2. The feeding structure of claim 1, further comprising a feeding point defined as one end portion of the feed unit, wherein the feeding point is provided between the first grounding unit and the second grounding unit.

3. The feeding structure of claim 2, wherein a third resonance loop is formed by the feeding unit and the second grounding unit.

4. The feeding structure of claim 3, wherein the third resonance loop is adjusted by the third regulator unit.

5. The feeding structure of claim 2, wherein the first regulator unit is connected with the third reactance element in parallel.

* * * * *